US007207200B2

(12) United States Patent
Eden, Jr. et al.

(10) Patent No.: US 7,207,200 B2
(45) Date of Patent: Apr. 24, 2007

(54) KEY WITH COMPOUND ACTUATOR RAMPS IN RECESSED LONGITUDINAL CHANNEL

(75) Inventors: Charles W. Eden, Jr., Plantsville, CT (US); Edward F. Humphrey, Southington, CT (US)

(73) Assignee: Kaba Ilco Corp., Winston-Salem, NC (US)

( * ) Notice: Subject to any disclaimer, the term of this patent is extended or adjusted under 35 U.S.C. 154(b) by 0 days.

(21) Appl. No.: 11/223,483

(22) Filed: Sep. 8, 2005

(65) Prior Publication Data

US 2006/0027004 A1 Feb. 9, 2006

Related U.S. Application Data

(60) Division of application No. 10/834,600, filed on Apr. 27, 2004, now Pat. No. 6,983,630, which is a continuation-in-part of application No. 10/616,591, filed on Jul. 9, 2003, now Pat. No. 7,028,517.

(51) Int. Cl.
*E05B 19/06* (2006.01)

(52) U.S. Cl. ..... 70/358; 70/409; 70/493

(58) Field of Classification Search ..... 70/409, 70/405, 406, 358, 492, 493, 356, 357, 378, 70/352, 392, 495, 389, 390, 407, 494
See application file for complete search history.

(56) References Cited

U.S. PATENT DOCUMENTS 3,877,267 A * 4/1975 Harris, Jr. ..... 70/358
4,116,025 A 9/1978 Wolter
4,122,694 A * 10/1978 Gretler ..... 70/406

(Continued)

FOREIGN PATENT DOCUMENTS

DE 40 35 934 A 1 6/1991

(Continued)

*Primary Examiner*—Lloyd A. Gall
(74) *Attorney, Agent, or Firm*—Alix, Yale & Ristas, LLP

(57) ABSTRACT

A key blank and key for mating with a core having a plurality of cutouts penetrating from the core surface to the keyway, and a plurality of activator inserts and filler inserts, such that the installer can locate one or more activator inserts in any of the cutouts, and one or more filler inserts in any of the remaining cutouts, to thereby match the code to be provided in the respective flank or flanks of an authorized key. At least three and preferably at least five slotted cutouts are provided. The inserts are preferably in the form of generally semi-circular plates on at least one side of the core. The inventive key for insertion into a cylinder lock keyway has a blade with top and bottom edges spaced apart along a blade height direction and left and right flanks spaced apart along a blade width direction. A longitudinal channel is formed in at least one flank, having a width extending in the blade height direction and a depth extending in the blade width direction. At least one raised node is situated in the channel, each node having a front ramp facing the tip of the blade, a back ramp facing the bonnet, a side face between the front and back ramps defining a substantially flat side surface substantially parallel to the blade height direction, and an actuator surface contiguous with the front ramp, back ramp, and side surface.

16 Claims, 19 Drawing Sheets

U.S. PATENT DOCUMENTS

| | | | | |
|---|---|---|---|---|
| 4,325,242 | A | 4/1982 | Teitz | |
| 4,377,082 | A | 3/1983 | Wolter | |
| 4,612,787 | A | 9/1986 | Prunbauer et al. | |
| 4,964,288 | A | 10/1990 | Braun et al. | |
| 5,079,936 | A | 1/1992 | Stefanek | |
| 5,101,648 | A | 4/1992 | Kuster | |
| 5,222,383 | A | 6/1993 | Fann et al. | |
| 5,247,818 | A | 9/1993 | Lo | |
| 5,438,857 | A | 8/1995 | Kleinhaeny | |
| 5,533,369 | A | 7/1996 | Valdajos-Gallego | |
| 5,682,779 | A | 11/1997 | Dolev | |
| 5,797,287 | A | 8/1998 | Prunbauer | |
| 5,819,566 | A | 10/1998 | Eden, Jr. | |
| 5,819,567 | A | 10/1998 | Eden, Jr. | |
| 5,839,308 | A | 11/1998 | Eizen et al. | |
| 5,970,761 | A | 10/1999 | Eden, Jr. | |
| 6,058,750 | A | 5/2000 | Li | |
| 6,257,033 | B1 | 7/2001 | Ziv-Av | |
| 6,519,988 | B1 | 2/2003 | Wu | |
| 6,983,630 | B2 * | 1/2006 | Eden et al. | 70/493 |
| 7,028,517 | B2 * | 4/2006 | Divito | 70/493 |
| 2005/0210939 | A1 * | 9/2005 | Divito | 70/409 |

FOREIGN PATENT DOCUMENTS

| | | | |
|---|---|---|---|
| EP | 431-550 | A | 6/1991 |
| NL | 7317-470 | | 3/1975 |

* cited by examiner

KEY WITH COMPOUND ACTUATOR RAMPS IN RECESSED LONGITUDINAL CHANNEL

RELATED APPLICATION

This application is a divisional of U.S. patent application Ser. No. 10/834,600, filed Apr. 27, 2004, now U.S. Pat. No. 6,983,630 which is a continuation-in-part of U.S. application Ser. No. 10/616,591, filed Jul. 9, 2003, now U.S. Pat. No. 7,028,517, from which the benefit of 35 U.S.C. §120 and 121 is claimed.

BACKGROUND OF THE INVENTION

The present invention relates to cylinder locks, and more particularly, to programmable cylinder locks.

The development of security locks has focused for a number of years on not only enhancing the intricacy of the primary coding between the key and the lock mechanism, but furthermore, in developing secondary coding which must also be satisfied in order for the lock to operate properly. Moreover, in some instances a further security feature is provided, according to which an unauthorized key is trapped during an attempt to operate the lock.

Although these prior techniques are effective for their intended purpose of enhancing the security of the lock, the enhanced security features typically involve somewhat intricate machining of components or complex placement of components during assembly of the lock. Furthermore, the particular coding necessary for authorized operation of the lock must with typical prior art techniques, be established in the lock by the lock manufacturer or distributor. This complexity increases the cost of the lock system, and often limits the flexibility and timeliness of the installation and/or replacement of high security locks.

SUMMARY OF THE INVENTION

It is accordingly an object of the present invention, to provide a key blank and key for a programmable cylinder lock system that has enhanced security and preferably key trapping features.

It is a particular object of the invention that the core portion of the cylinder lock be programmable in the field, by a locksmith or an installer.

It is a further object of the invention that the programmability and enhanced security be implemented in a relatively simple yet clever manner, that does not require intricate machining or complex assembly by either the lock manufacturer or the installer.

It is a further object to provide a key blank having an enhanced security coding that can readily be manufactured, but which if imitated without authority, will not only fail to operate, but can optionally be trapped.

According to a broad aspect of the invention, a plurality of programmable cut outs extend from the outer surface of the core to penetration of at least one keyway sidewall at an intermediate angle to the cylinder axis, each programmable cut out having an associated support surface within the core intermediate the core surface and the keyway. An activator insert is locatable in at least one of the programmable cut outs. The activator insert has an outer portion adjacent the core surface and an inner portion that can freely enter into the keyway. It is displaceable in the cut out between a rest position wherein an unauthorized (or no) key is in keyway, the inner portion is in the keyway, and the outer portion is recessed from the core surface, and an active position wherein a properly coded key is in the keyway, the inner portion of the insert bears on a laterally or obliquely projecting node in the key, and the outer portion is at the core surface. A filler insert is locatable in each of the remainder of the programmable cutouts. Each filler insert has an outer portion at the core surface and an inner portion supported by the support surface such that the filler insert cannot enter into the keyway.

If an unauthorized key successfully fully enters the keyway but is not coded for proper activation of the activator insert, rotation of the core can be initiated but upon registration of a programmed cutout with a shell tumbler, the tumbler will cross the shear line, enter the cutout, and prevent further rotation. If the key is properly coded, the activator insert will be displaced by the key to the core surface, thereby bridging the cut out at the surface, preventing the shell tumbler from crossing the shear line and thus maintaining clearance at the shear line. The filler inserts maintain the bridge under all conditions.

The cutouts and inserts can take a variety of forms. For example, the cut outs can be slots or bores, and the inserts can be plates or pins. The cutouts and associated support surfaces can have any form that accomplishes several purposes: (a) under some conditions define a recess at the core surface that can receive a shell tumbler across the shear line, (b) under other conditions the recess can be bridged by a programmable insert in the presence of a properly programmed key in the keyway to maintain clearance in the shear line, and (c) providing a shelf for supporting a filler insert that bridges the recess whether or not a properly programmed key is in the keyway. The recesses can be in the form of distinct counter bores, or other recessed shapes that can overlap across two or more cutouts, thereby permitting use of a unitary filler insert that spans multiple cutouts. If key trapping is not desired, the edges of the recesses at the core surface can be cambered to facilitate raising of the fallen shell tumbler upon reverse rotation of the key and core.

In an inventive cylinder having a plurality of cutouts penetrating from the core surface to the keyway, and the availability of a plurality of activator inserts and filler inserts, the installer can locate one or more activator inserts pins in any of the cutouts, and one or more filler inserts in the remaining cutouts, to thereby define a code to be provided in the respective flank or flanks of an authorized key. Preferably at least three such cutouts are provided on at least one side of the core, but as a practical matter, four or more cutouts on each side of the core offers sufficient variations to thwart all but the most sophisticated attempts at gaining unauthorized entry.

Preferably, five cutouts on each side of the core are fitted with a pattern of activator inserts and filler inserts, whereas a sixth cutout on each side, closest to the back end of the core, is fitted with a blocking insert. The cut out for the blocking insert need not be of the same type as for programming, i.e., the activator cutouts can be slots whereas the cutouts for pin-type blocking inserts can be bores.

In various embodiments, the present invention is directed to a programmable cylinder lock system, a programmable core for a cylinder lock, a core kit by which the installer can program the core in the field, and a novel key adapted to be used with the programmable core.

The programmable cylinder lock comprises a substantially cylindrical core having front and back ends and a keyway having a key entry at the core front end and sidewalls shaped to closely receive a key blade having opposed top and bottom edges and opposed left and right flanks. A substantially cylindrical shell has a longitudinal bore closely coaxially surrounding the outer surface of the core. The core has a neutral position within the shell such that the keyway top and bottom are at 0 and 180 degree positions, respectively, relative to the axis when viewed from the keyway entry and the core can rotate within the shell bore when a properly coded key is fully inserted in the keyway. A plurality of tumbler bores are located in the shell and penetrate the shell bore at a 0 degree angle relative to the neutral position of the core. A respective plurality of tumblers are located in the tumbler bores and biased toward the shell bore so as to contact the core. A plurality of programmable cut outs extend from the outer surface of the core to penetration of at least one keyway sidewall at an intermediate angle to the axis. Each programmable cut out has as associated support surface within the core. An activator insert is situated in at least one of the cutouts and has an outer portion adjacent the core surface, and an inner portion that can freely enter into the keyway. The activator insert is displaceable in the cut out between a rest position wherein no key is in the keyway, the inner portion is in the keyway, and the outer portion is recessed from the core surface, and an active position wherein a properly programmed key is in the keyway, the inner portion of the insert bears on the key, and the outer portion is at the core surface. A filler insert is in each of the remainder of the programmable cut outs. Each filler insert has an outer portion at the core surface and an inner portion supported by the support surface such that the filler insert cannot enter into the keyway.

The programmable core for a cylinder lock comprises a substantially cylindrical core having an outer surface, front and back ends and a keyway having a key entry at the core front end and extending along the core longitudinal axis toward a core back end. The keyway has opposed top and bottom walls and opposed left and right sidewalls shaped to closely receive a key blade having opposed top and bottom edges and opposed left and right flanks, such that the keyway top and bottom are at 0 and 180 degree positions, respectively, relative to the axis when viewed from the keyway entry. The outer surface of the core has at least three left side cut outs between but not including the 0 and 180 degree positions and extending from the outer surface of the core to penetration of the keyway left sidewall, and at least three right side cutouts between but not including the 0 and 180 degree positions, extending from the outer surface of the core to penetration of the keyway right sidewall.

In the preferred embodiment of the cylinder lock, the cut outs are in the form of a plurality of left side slots extending from the outer surface of the core to penetration of the keyway left sidewall, and a plurality of right side slots extending from the outer surface of the core to penetration of the keyway right sidewall. The activator inserts are in the form of plates having a projection into the keyway. Filler members are in at least one left side slot or at least one right side slot. The filler member has a shape for interacting with the slot such that the member cannot enter into the keyway. A key is insertable into the keyway, each of the flanks having a longitudinal channel alignable with the plurality of left side slots and/or right side slots. At least one of the channels has a raised node alignable with the projection on an activator plate, whereby insertion of the key urges the node against the projection, thereby displacing the plate in the slot while the projection remains in the keyway.

The preferred form of the programmable core kit for a cylinder lock is based on the foregoing preferred cylinder lock, wherein the cut outs are defined by a plurality of left side slots extending from the outer surface of the core to penetration of the keyway left sidewall and a plurality of right side slots extending from the outer surface of the core to penetration of the keyway right sidewall. A plurality of activator plates are insertable in at least one of a left side slot or a right side slot, each activator plate having a substantially semi-circular shape with the diametrical portion adjacent the keyway and the arcuate portion adjacent the core outer surface, the diametrical portion having a transverse projection for entering into the keyway. A plurality of filler members are insertable in each of the remainder of the programmable cut outs, each filler member having an outer portion at the core surface and an inner portion supported by the support surface such that the filler member cannot enter into the keyway.

One aspect of a key according to the invention comprises a bonnet for grasping with fingers, a blade extending in a longitudinal direction from the bonnet to a distal tip, and having top and bottom edges spaced apart along a blade height direction and left and right opposed flanks defining a cross sectional profile. The profile forms a longitudinally extending upper rectangular region having a substantially vertical upper wall on one flank, a longitudinally extending lower rectangular region having a substantially vertical lower wall on that one flank, and a longitudinally extending intermediate region between the upper and lower rectangular regions. The intermediate region defines a longitudinally extending channel zone on the one flank that is in relief relative to the upper and lower walls. At least one raised node is situated in the channel zone, each node having a front ramp facing the tip of the blade, a back ramp facing the bonnet, and an actuator surface between the front ramp and the back ramp. The actuator surface has an orientation that is oblique with respect to the upper and lower walls.

In another aspect of the inventive key for insertion into a cylinder lock keyway the blade has top and bottom edges spaced apart along a blade height direction and left and right flanks spaced apart along a blade width direction. A longitudinal channel is formed in at least one flank, having a width extending in the blade height direction and a depth extending in the blade width direction. At least one raised node is situated in the channel, each node having a front ramp facing the tip of the blade, a back ramp facing the bonnet, a side face between the front and back ramps defining a substantially flat side surface substantially parallel to the blade height direction, and an actuator surface contiguous with the front ramp, back ramp, and side surface.

BRIEF DESCRIPTION OF THE DRAWINGS

The preferred embodiment of the invention will be described in greater detail with reference to the accompanying drawings, in which.

DESCRIPTION OF THE PREFERRED EMBODIMENT

The present invention is an improvement to, and is based on, a conventional cylinder lock having a substantially cylindrical core for rotation within a substantially hollow cylindrical shell when a properly coded key is fully inserted within a coded keyway in the core. A conventional cylinder will not be further described herein, because one of ordinary skill in the art is very familiar with the way in which the bits on the top edge of a key blade cooperate with tumblers arranged between the shell and core to block the rotational shear line between the shell and the core when no key is present, and to clear the shear line when a properly bitted key is present.

The present invention provides an additional level of coding associated with the flank of the blade, and the portions of the core and shell which are not normally involved with the conventional cooperation of the key bits with the associated tumblers.

A first embodiment of the invention in a variety of forms including programmable cylinder, programmable cylinder lock, programmable cylinder system, and associated programmable key, will be described with respect to FIGS. 1–10. A second embodiment will be described with respect to FIGS. 11–23. Finally, a description of the inventive key, which can take a variety of additional forms, will be described with respect to FIGS. 24 and 25.

Figure 1:
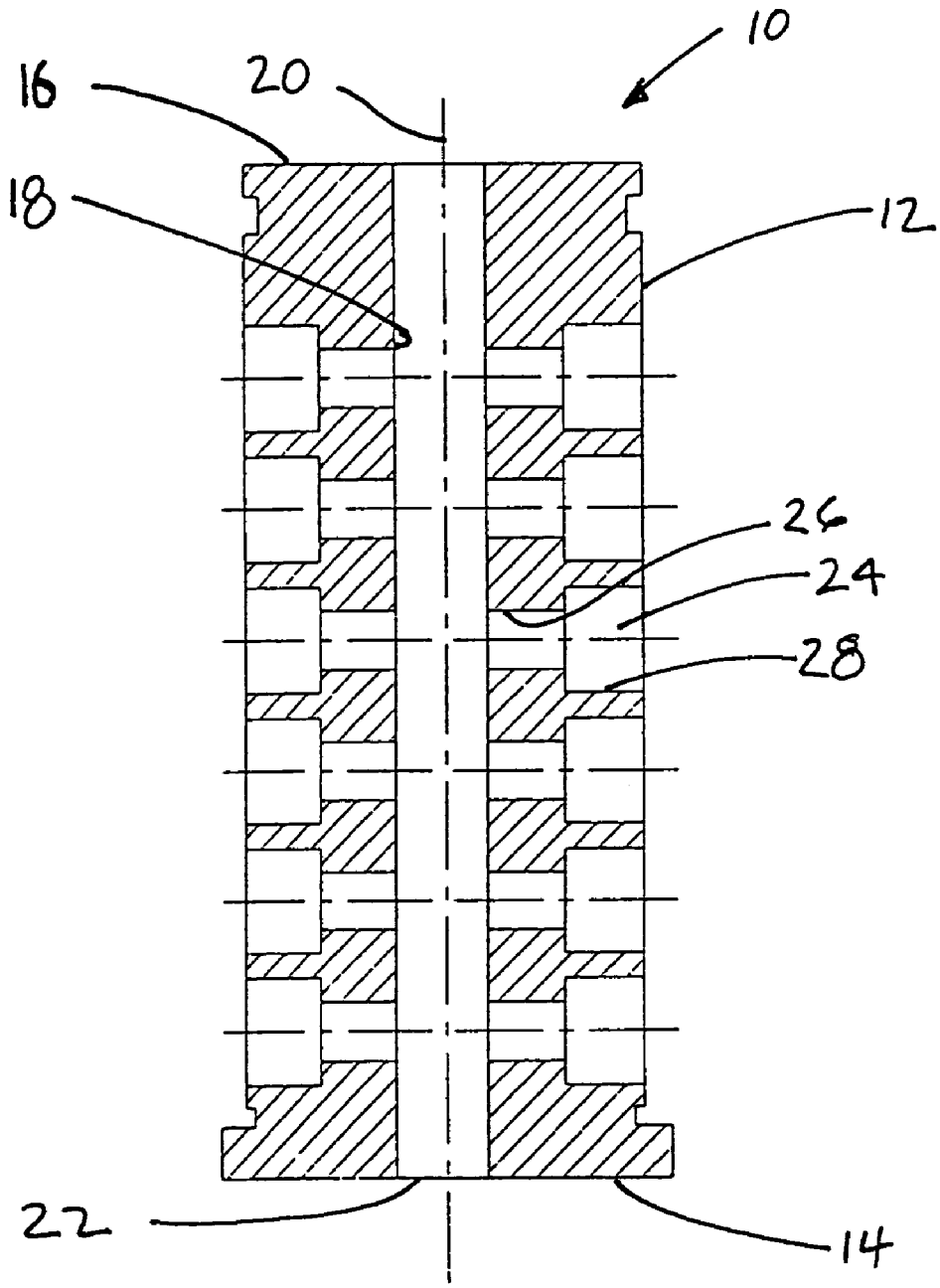
FIG. 1 is a longitudinal section view through a cylindrical core having a plurality of transversely oriented pin bores for receiving a variety of pins of different character whereby the core can be programmed in the field.
Figure 2:
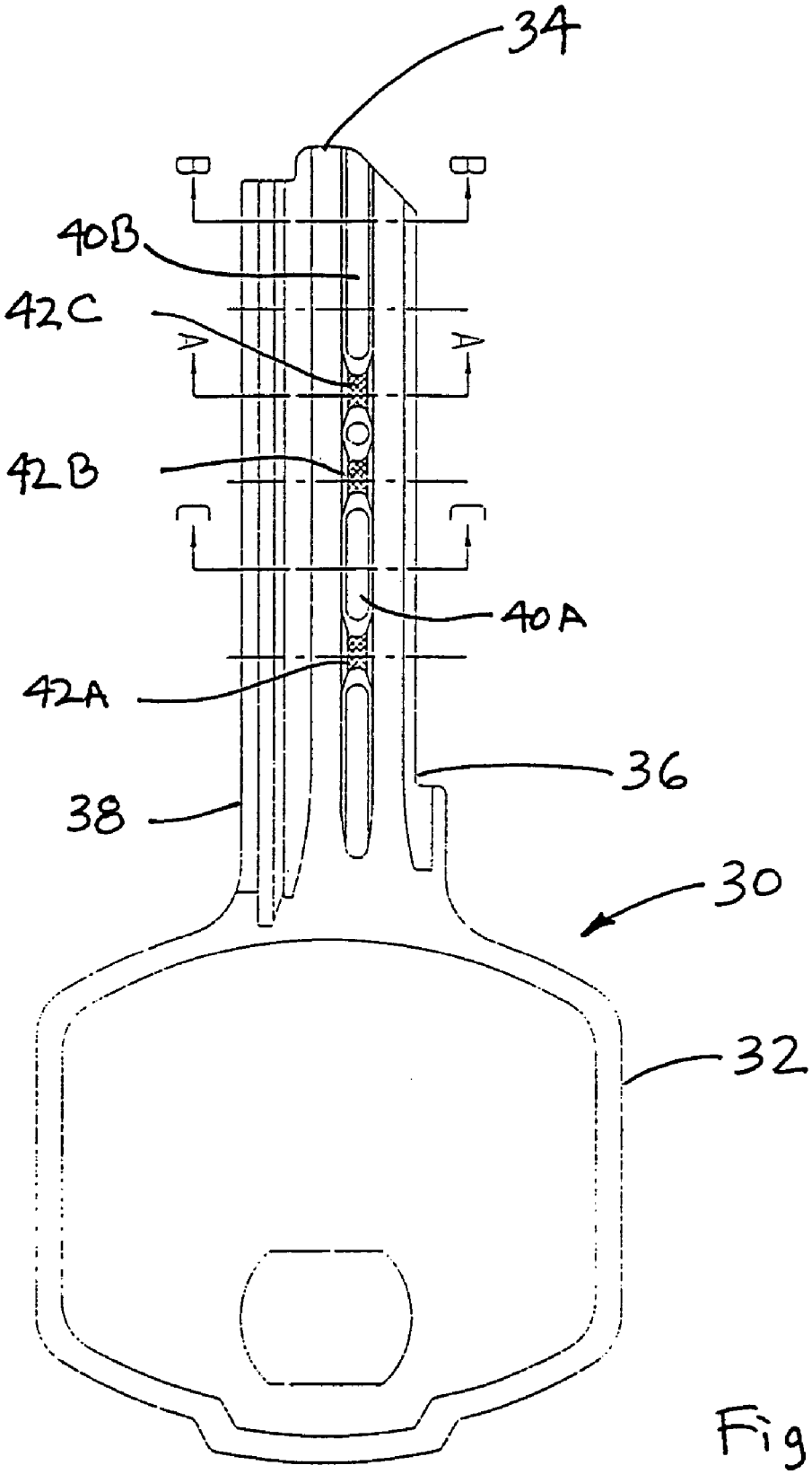
FIG. 2 is a plan view of a key adapted to be used with the programmable core according to the invention.
Figure 3:
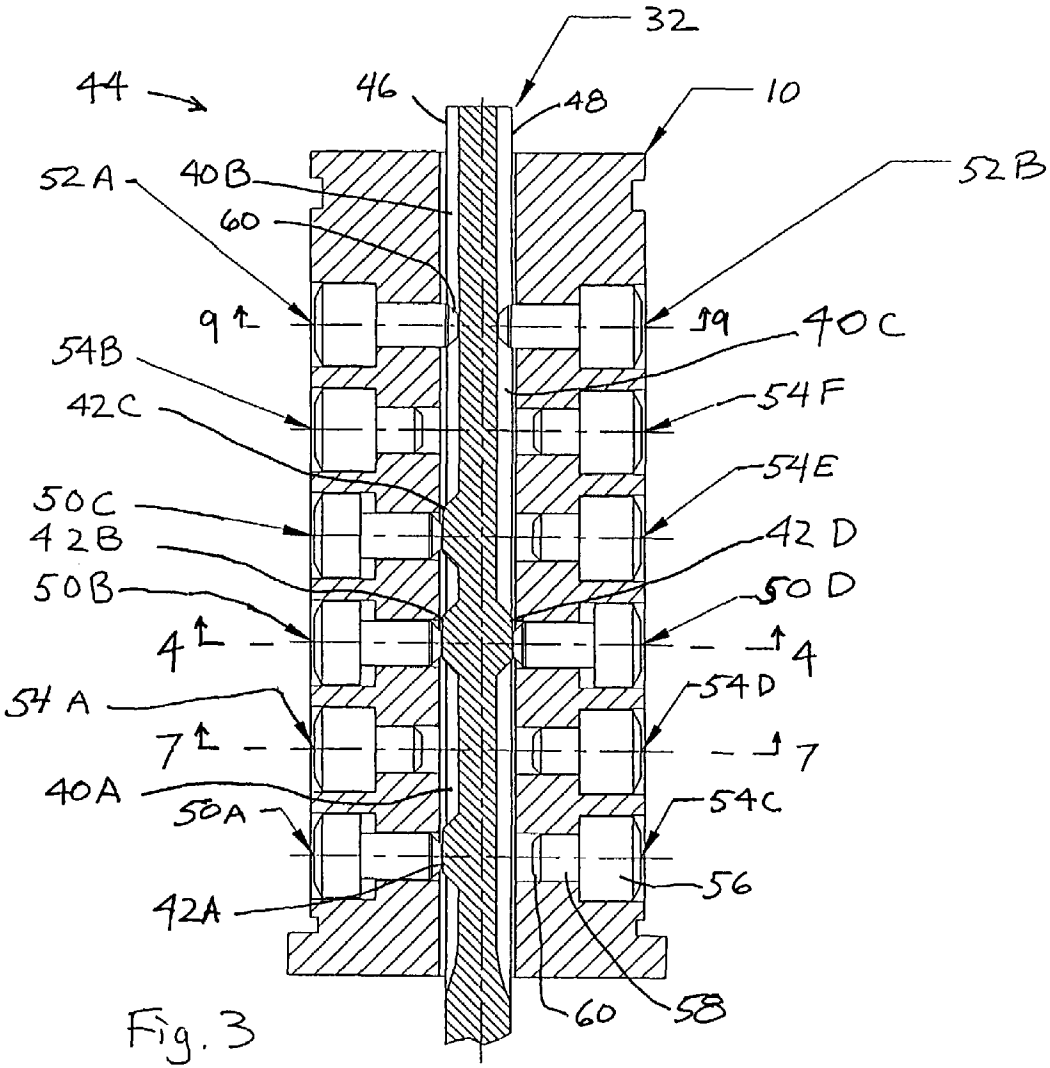
FIG. 3 is a section view similar to FIG. 1, but with a particular pattern of pins defining a security code, and an authorized key coded for compatibility with the coded core.

As shown in FIGS. 1–3, a programmable core 10 has a substantially cylindrical body 12 with a front end 14, a back end 16, and a keyway 18 centered on the core axis 20, with a keyway entry 22 at the front end. The plurality of pin bores 24 extend from the outer surface of the core transversely to the axis a uniform distance to the keyway. Each pin bore preferably has an inner through bore portion 26 and an outer, enlarged counter bore portion 28.

A key 30 having a bonnet portion 32 for grasping between the fingers, and a blade portion 34 extending from the bonnet, has a top edge 36, a bottom edge 38 and left and right flanks 46, 48 defining a thickness corresponding to the width of the keyway as established by the opposed left and right side walls. The left flank 46 has a recessed longitudinal channel portions of which are indicated at 40A and 40B, and the right flank 48 has a right side longitudinal channel, a portion of which is indicated at 40C. In the illustrated embodiment, the key nodes 42A, 42B, and 42C rise above the left channel so as to lie substantially in the same plane as the planer surface of flank 46. Similarly, node 42D rises from the right channel, into the plane of right side flank 48.

Each of the pin bores 26 has an associated pin located therein, but three different types of pins occupy respective bores. Activator pins 50A, 50B and 50C have an overall length substantially equal to the length of the pin bore, and the shape of this type pin interacts with the pin bore such that the pin can freely enter into the keyway in the absence of a confronting node on the key, such as 42A, 42B, and 42C respectively. In particular, the height of the head 56 on the activation pins 50A, 50B, and 50C is less than the height of the counter bore 28, whereby the stem 58 of the activator pin can drop through the pin bore into the keyway, in the absence of a supporting surface at the keyway sidewall. In the presence of such supporting surface, the head portion 56 is flush with the core outer surface. Only one activator pin 50D is provided on the right side of the core, shown with an associated key node 42D. The significance of the activator pins will be discussed below in greater detail.

Preferably adjacent to the back end 16 of the core, a pair of opposed blocking pins 52A, 52B are provided, each having an overall length that is greater than the length of the pin bores, such that when the head of the blocking pin is seated within the respective counter bore, the head is flush with the core outer surface and the pin stem 58 enters into the keyway. In particular, the nose portion 60 of the stem extends into the channel 40B of a properly coded key. It can be appreciated that if the leading portion of a key is not channeled, the key cannot pass beyond the blocking pins and therefore cannot fully insert into the keyway.

Filler pins 54A and 54B, are shown on the left side of the core. Like the blocking pins, the heads on the filler pins are preferably shaped to fill the counter bore while remaining flush with the outer surface of the core, but unlike in the blocking pins, the stem of the filler pin is shortened such that the overall length of the filler pin is no greater than the overall length of the pin bore.

It should thus be understood that, according to the invention, a programmable core installation kit can be provided comprising a core having a plurality of pin bores penetrating from the core surface to the keyway, and a plurality of at least the activator pins and filler pins, such that the installer can locate one or more activator pins in any of the pin bores, and one or more filler pins in any of the remaining bores, to thereby define a code to be provided in the respective flank or flanks of an authorized key. Preferably at least three bores are provided on at least one side of the core, but as a practical matter, four or more pin bores provided on each side of the core offers sufficient variations to thwart all but the most sophisticated attempts at gaining unauthorized entry. Preferably, five pin bores on either side of the core are fitted with a pattern of activator pins and filler pins, whereas a sixth pin bore on each side, closest to the back end of the core, is fitted with a blocking pin. Although not likely to be utilized in practice, the invention includes the extreme cases of programming with all pin bores having activator pins or all pin bores having filler pins, or the pin bores being provided on only one side of the core.

The security effect of the activator pins will be described with respect to FIGS. 4 and 5, which represents a cross section through a cylinder lock system 62 taken through line 4—4 of FIG. 3. (The tumbler bores and tumblers at the 0 degree position in the core for interacting with the bitting on the upper edge of the have been omitted for clarity). To enhance further understanding, it should be understood that FIG. 3 is a section view taken through line 3—3 of FIG. 4. The shell 64 according to the invention has a plurality of tumbler bores 68 located in the same planes as the center lines of the pin bores shown in FIG. 3. Each tumbler bore 68 includes a tumbler 70 with associated spring or the like 72 which biases the tumbler toward the programmed core 44.

For convenience in understanding the further description contained herein, it should be understood that the shell has a longitudinal bore 66 in which the programmed core 44 is closely surrounded such that the core can rotate within the shell bore when a properly coded key is fully inserted into the keyway. The key upper and lower edges 36, 38 are aligned vertically when the core and keyway are in the neutral position, i.e., the keyway top and bottom are at the zero and 180 degree positions, respectively, relative to the axis when viewed from the keyway entry. Thus, the tumbler bore 68 and associated tumbler 70 are at the zero degree angle, the right side pin bores and pin 50D extend along a 90 degree ray from the axis, and the left side pin bore and associated pin 50B extend along a 270 degree ray from the axis. In the plane illustrated in FIG. 4, the core outer surface at the zero degree position contacts the tumbler 70 at the shear line 74, permitting relative rotation. Such rotation resulting from a one-quarter turn clockwise (90 degree rotation clockwise) is illustrated in FIG. 5.

Figure 5:
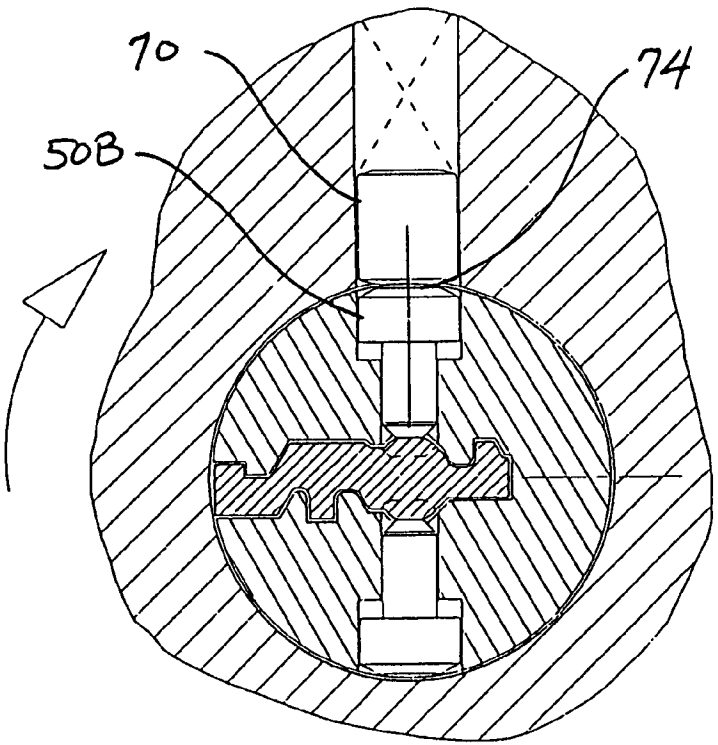
FIG. 5 is a view similar to FIG. 4, upon rotation of the key and core, 90 degrees clockwise.
Figure 4:
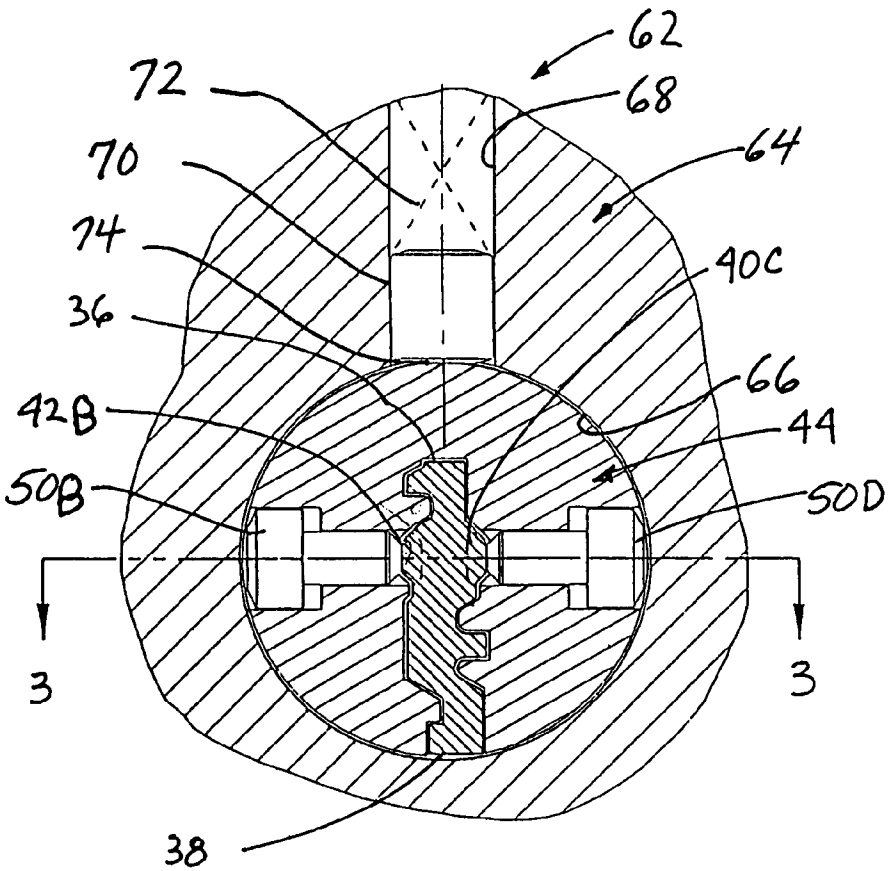
FIG. 4 is a cross sectional view of the programmed core with authorized key as part of a cylinder lock system, taken along the line 4—4 of FIG. 3, in the plane of two activation pins.

It can be appreciated that the head of activator pin 50B remains at the outer surface of the core both at the neural position of the core shown in FIG. 4, and the rotated position of the core shown in FIG. 5, thereby preserving the rotational clearance at shear line 74. Notwithstanding the effect of gravity on pin 50B when it is at the zero degree position shown in FIG. 5, the node 42B on the key supports the pin 50B at the surface of the core, preventing the tumbler 70 from dropping and blocking the shear line. In this particular embodiment, another activator pin 50D is at the 90 degree position in FIG. 4, supported by node 40C, thereby maintaining pin 50D in a position that will not permit blockage of the shear line if the key were rotated 90 degrees counter clock wise from the neutral position in FIG. 4. It can further be appreciated that the conditions shown in FIGS. 4 and 5, whereby the core turns freely within the shell, are applicable to the other node positions shown in FIG. 3.

Figure 6:
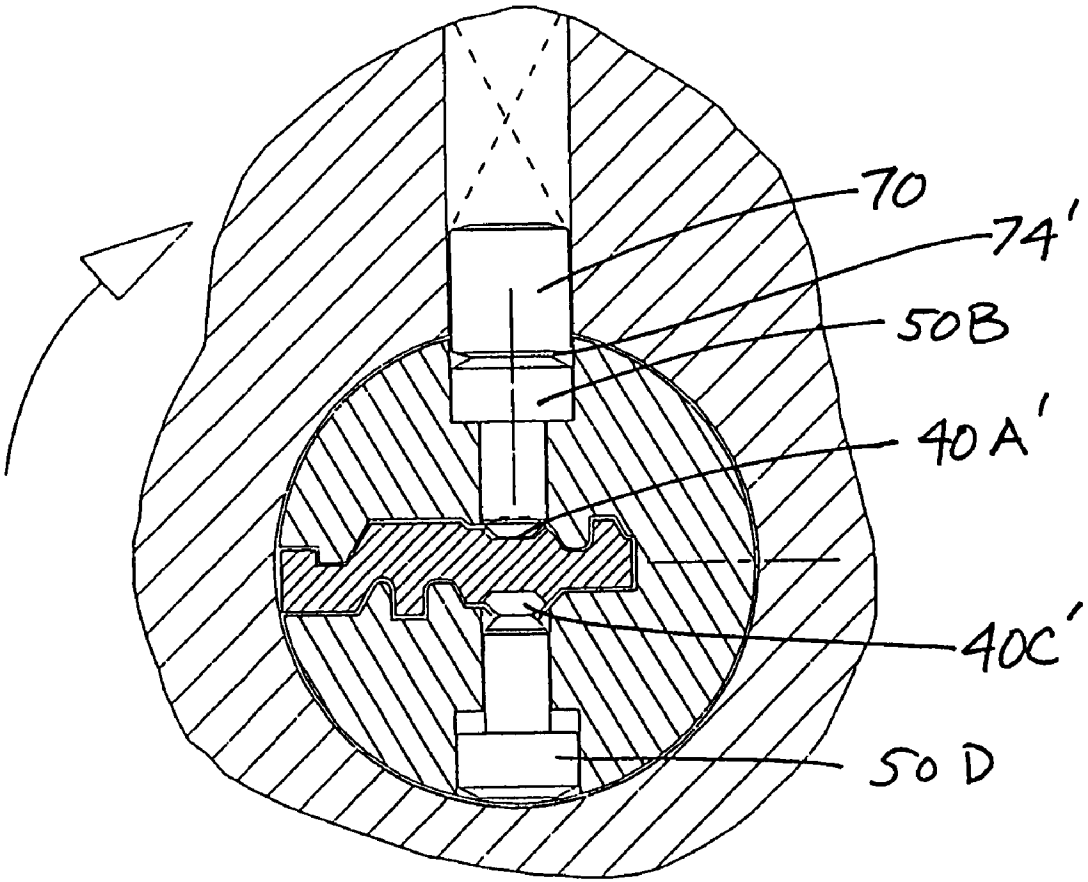
FIG. 6 is a cross sectional view similar to FIG. 5, but with an unauthorized key, resulting in blockage of the shear line between the core and shell.

FIG. 6 shows the consequence of a key that, although fully insertable in the keyway (because the bitting at the top edge has been accurately copied), cannot properly operate the lock because the activator pin 50B dropped under the influence of the tumbler 70 into channel portions 40A' of the key, i.e., at the location where an authorized key has node 42A.

Figure 8:
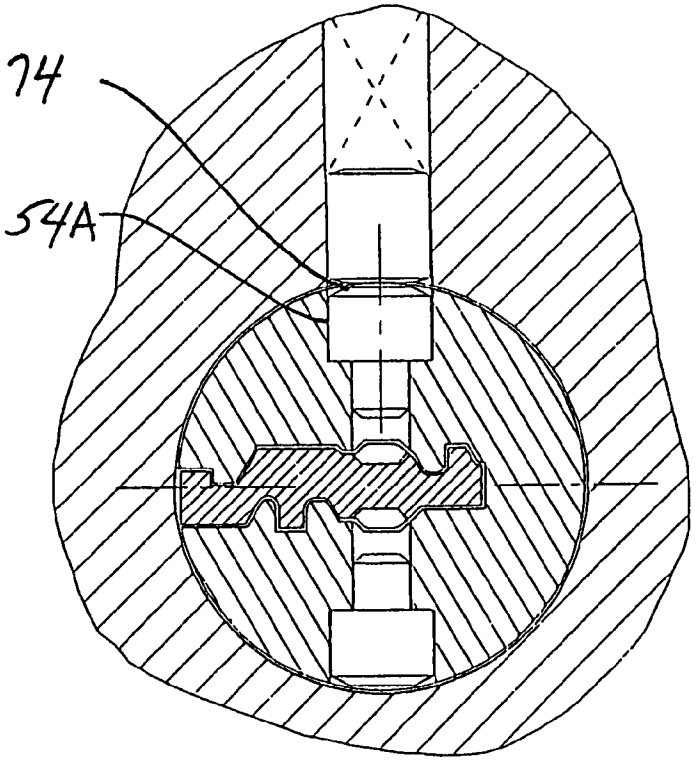
FIG. 8 is a view similar to FIG. 7, but with the key and core rotated 90 degree clockwise, showing no effect on the clear shear line.
Figure 7:
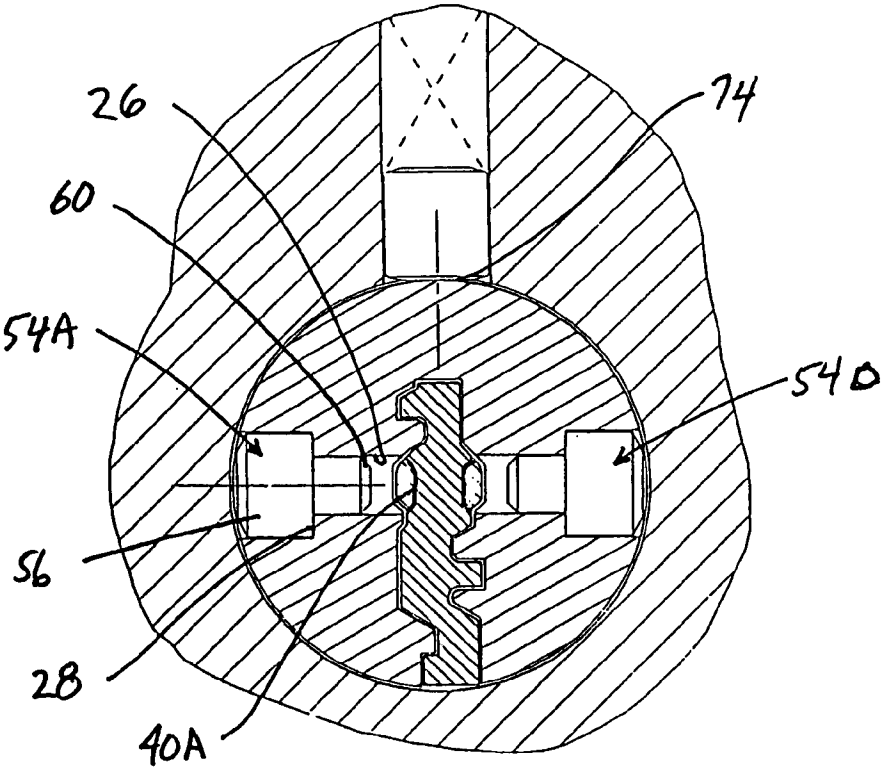
FIG. 7 is a cross sectional view of a cylinder lock system according to the invention, taken through line 7—7 of FIG. 3, in the plane of two filler pins.

FIGS. 7 and 8 show the cooperation of the key and filler pins, such as 54A aligned with channel portions 40A. The nose 60 of pin 54A is not influenced by the key, whether or not a channel 40A or unauthorized node is present. Inasmuch as the head 56 fully occupies the counter bore portion 28, when the key is rotated 90 degree clock wise as shown in FIG. 8, the head portion of pin 54A remains at the core outer surface, holding up the opposed tumbler and maintaining clearance at the shear line 74. A similar filler pin is shown at 54D, opposite pin 54A. In essence, the filler pins prevent locking of the core relative to the shell in the non activated areas of the key.

Figure 10:
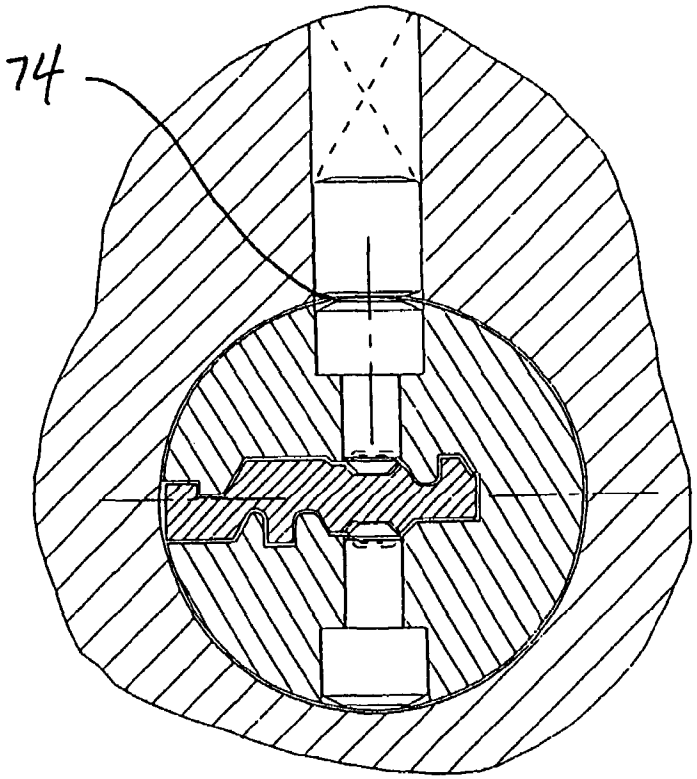
FIG. 10 is a cross sectional view similar to FIG. 9, with the key and core rotated 90 degree clockwise, showing that the clear shear line is maintained with a properly coded key.
Figure 9:
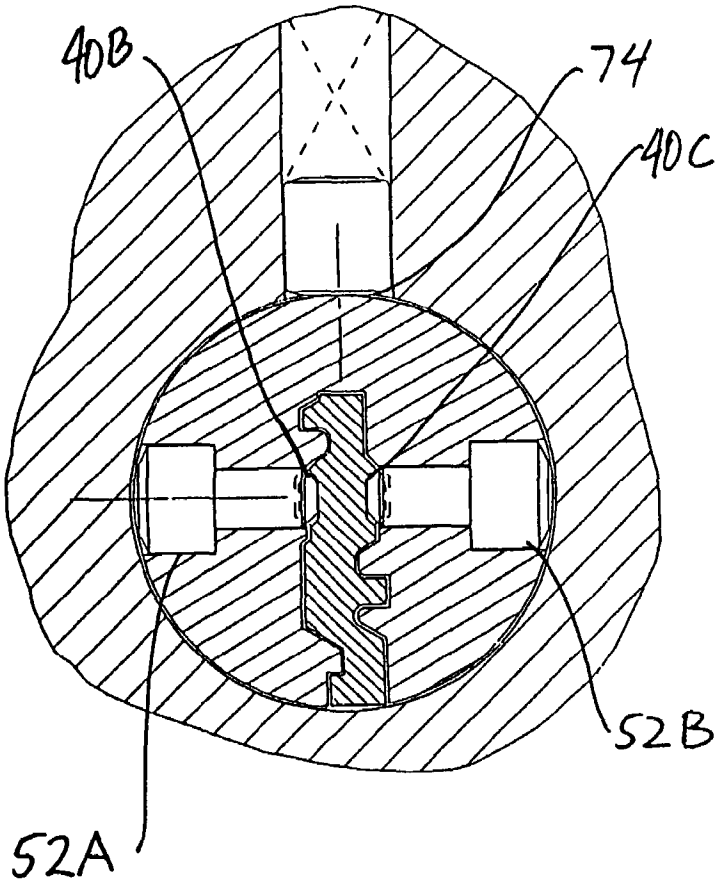
FIG. 9 is a cross section view through a cylinder lock system according to the invention, taken along line 9—9 of FIG. 3, showing blocking pins mating with channels in the key.

FIGS. 9 and 10 show the operation of the blocking pins 52A, 52B, whereby the key may pass via channel portions 40B and 40C. The shape and length of these pins maintains shear line clearance upon rotation.

It should be understood that variations to the illustrated embodiment can be made without departing from the spirit and scope of the claims. For example, the pin bores can be situated at acute angles (other than 90 and/or 270 degrees) relative to the neutral plane of the assembly or the insertion plane of the keyway, so long as the associated pins can interact with a channel and associated node in the flank of a proper key. Such acute angles and the 90 and 270 degree angles can be referred to collectively as "intermediate" angles relative to the zero and 180 degree positions.

The second embodiment of the invention will be described with reference to FIGS. 11–23. The structures are identified by three-digit numerals, wherein the second and third digits indicate analogous structure identified by the same two digit numeral in the first embodiment, i.e., the plug or core 110 in FIG. 11 corresponds to the plug or core 10 in FIG. 1.

In FIGS. 11–14, the core or plug 110 has a generally cylindrical body 112, having a front end 114 and a back end 116. Keyway 118 traverses the plug longitudinally along the axis 120. Entry 122 is at the front end, for receiving of a key 132. The core 110 has a plurality of left side cut-outs and right side cutouts 124, which in the present embodiment are in the form of slots which span a substantial angle in the range of 100–145 degrees, typically more than about 120 degrees. As discussed in the previous embodiment and as illustrated in U.S. Pat. No. 5,819,567, the core 110 would typically have tumbler bores 176 and associated tumblers (not shown), that in the neutral position of the core, align with respective tumbler bores and tumblers in the shell at the 12 o'clock or zero degree orientation of the core as viewed along the axis from the front end 114. The cutouts or slots 124 preferably align with respective bores 176 in respective planes transverse to the core axis. The upper ends of the slots 124 are counterbored at 128, with a bore diameter that is substantially the same as the diameter of the tumbler bores in the shell and the tumbler bores 176 in the core. Although these counterbores 128 may be individual, cylindrical apertures associated with respective cutouts 124, they are preferably "connected" together to form a continuous recess relative to the surface of core 110. These bores extend only partway through the core and therefore from a pocket or the like defining a support surface for receiving filler inserts to be discussed further below.

Figure 11:
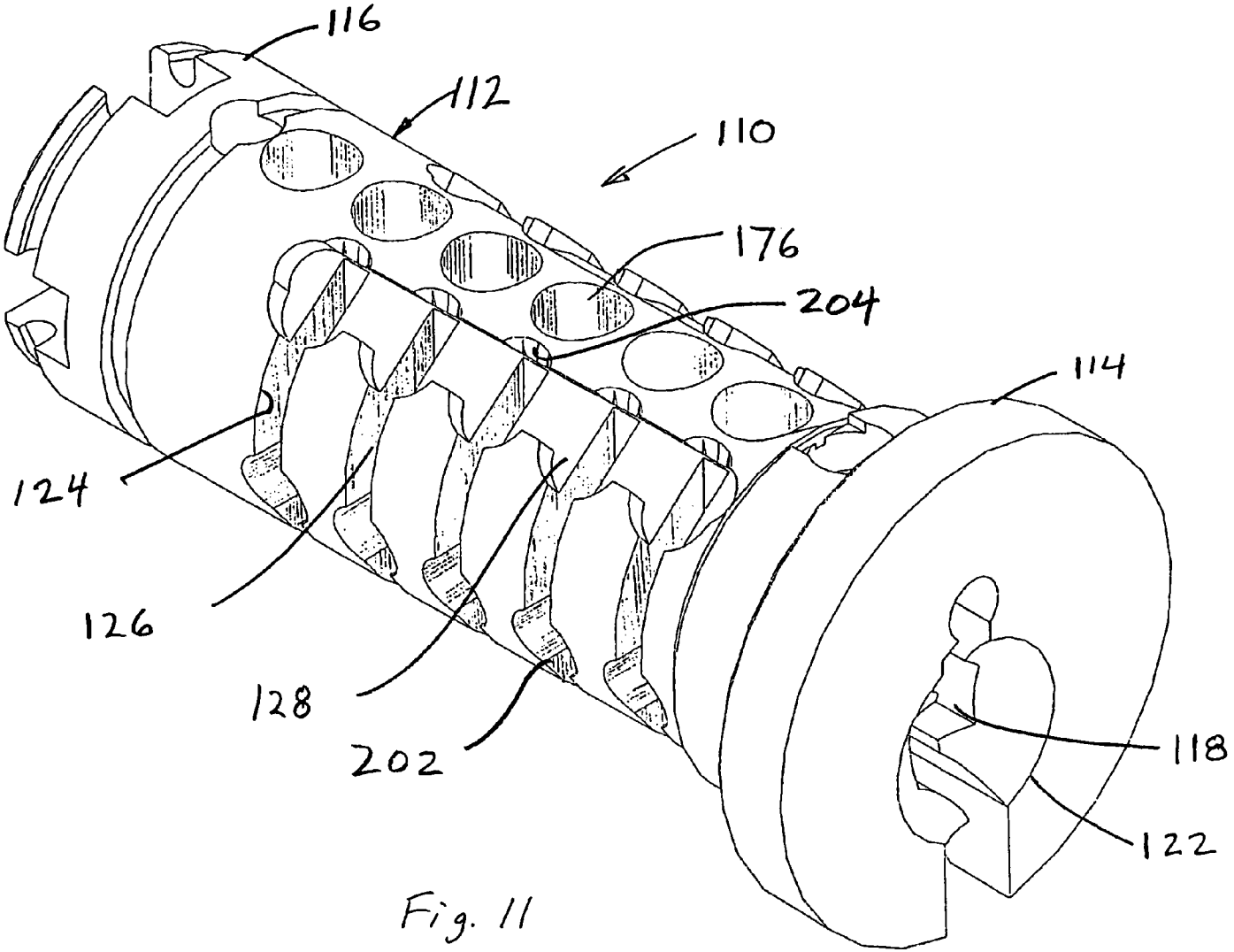
FIG. 11 is a perspective view of a programmable cylinder lock core according to a second embodiment of the invention, in the absence of any programmable inserts.
Figure 12:
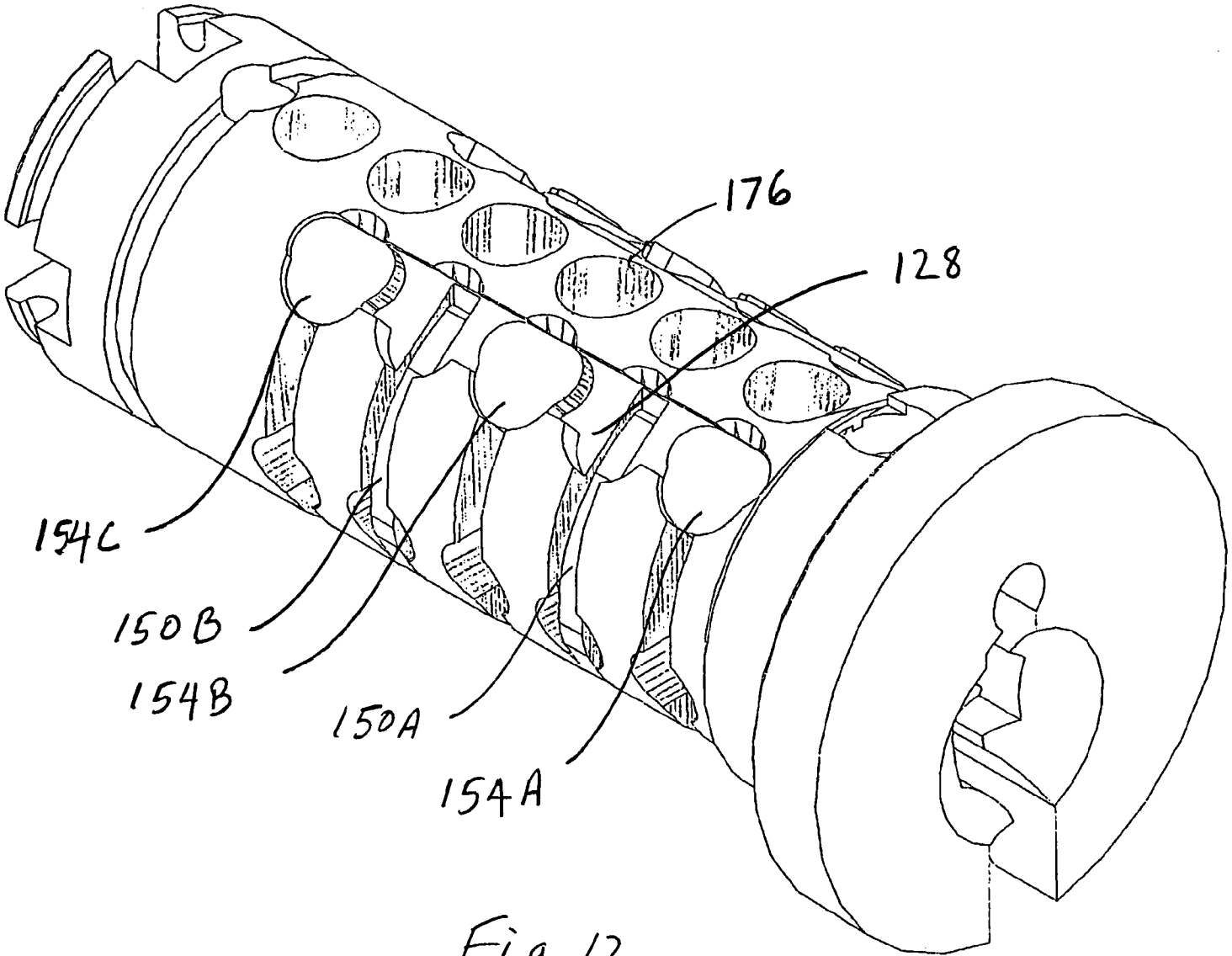
FIG. 12 is a perspective view similar to FIG. 11, showing activator inserts in the second and fourth locations on the left side of the core, and filler inserts in the first, third and fifth locations on the left side of the core, prior to the insertion of a key into the keyway.
Figure 13:
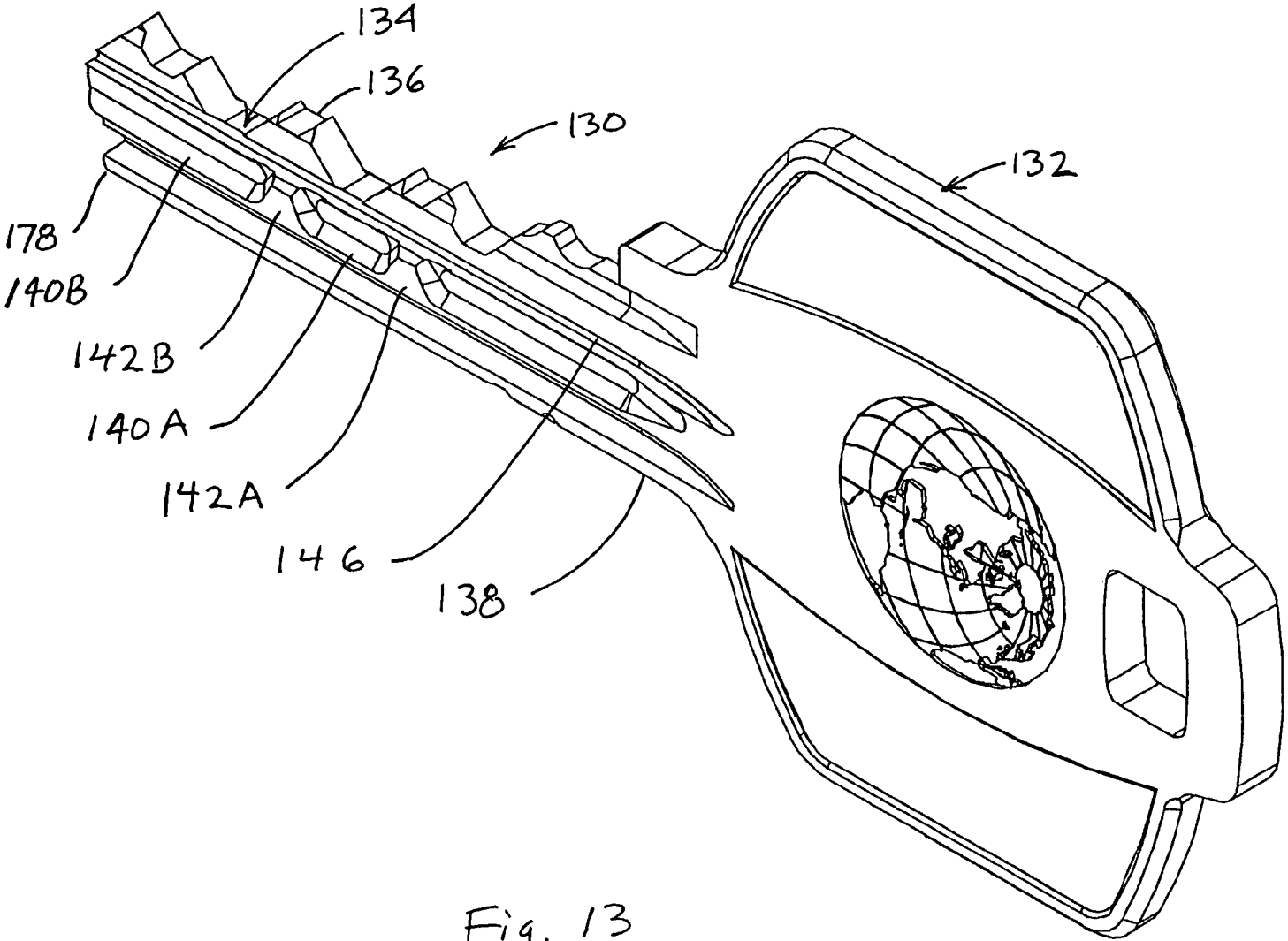
FIG. 13 is a perspective view of a properly programmed key that is compatible with the cylinder lock as programmed according to FIG. 12.

In FIG. 11, there are no program inserts in any of the cutouts. In FIG. 12, activator inserts 150*a* and 150*b* are shown in the second and fourth slots from the front of the core, whereas filler inserts 154*a*, 154*b*, and 154*c*, are shown in the first, third and fifth cutouts. It should be appreciated that a pattern of inserts can also be made on the right side of the core, but the present discussion with respect to FIGS. 11–14 will only refer to the left side of the core, and the associated left side of the programmed key. FIG. 13 shows a properly programmed key 130 having a bonnet 132, and a longitudinally extending blade 134. The blade has an upper edge 136 and a lower edge 138. As illustrated, the upper edge of the key has been coded with bitting, but it should be appreciated that the invention also applies to a key blank, wherein the upper edge has not been coded. The left flank 146 (and optionally right flank 148 not shown in this view) between the upper and lower edges, has a longitudinal channel milled therein. Channel portions 140*a* and 140*b* are shown along with program nodes 142*a* and 142*b* situated in the channel.

It can be appreciated by inspection of FIG. 12, that the activator inserts 150*a* and 150*b* are situated in the core such that the respective pockets 128 are open, and that upon rotation of the core, for example clockwise, these pockets will follow a path to arrive at the location and/or orientation previously occupied by an adjacent tumbler bore 176. On the other hand, those locations having filler inserts, i.e. buttons or the like 154*a*, 154*b*, 154*c*, exhibit a surface continuity and upon rotation will present a solid surface, rather than a pocket, at the location previously occupied by tumbler bores 176. Upon insertion of the properly programmed key 130, it can be appreciated that, as shown in FIG. 14, the respective activator pins 150*a* and 150*b* have been displaced outwardly so that they provide a bridge across the respective pocket portions of the cutouts and such bridge would be translated to the positions previously occupied by the tumbler bores 176 upon rotation of the core with the properly programmed key.

Figure 14:
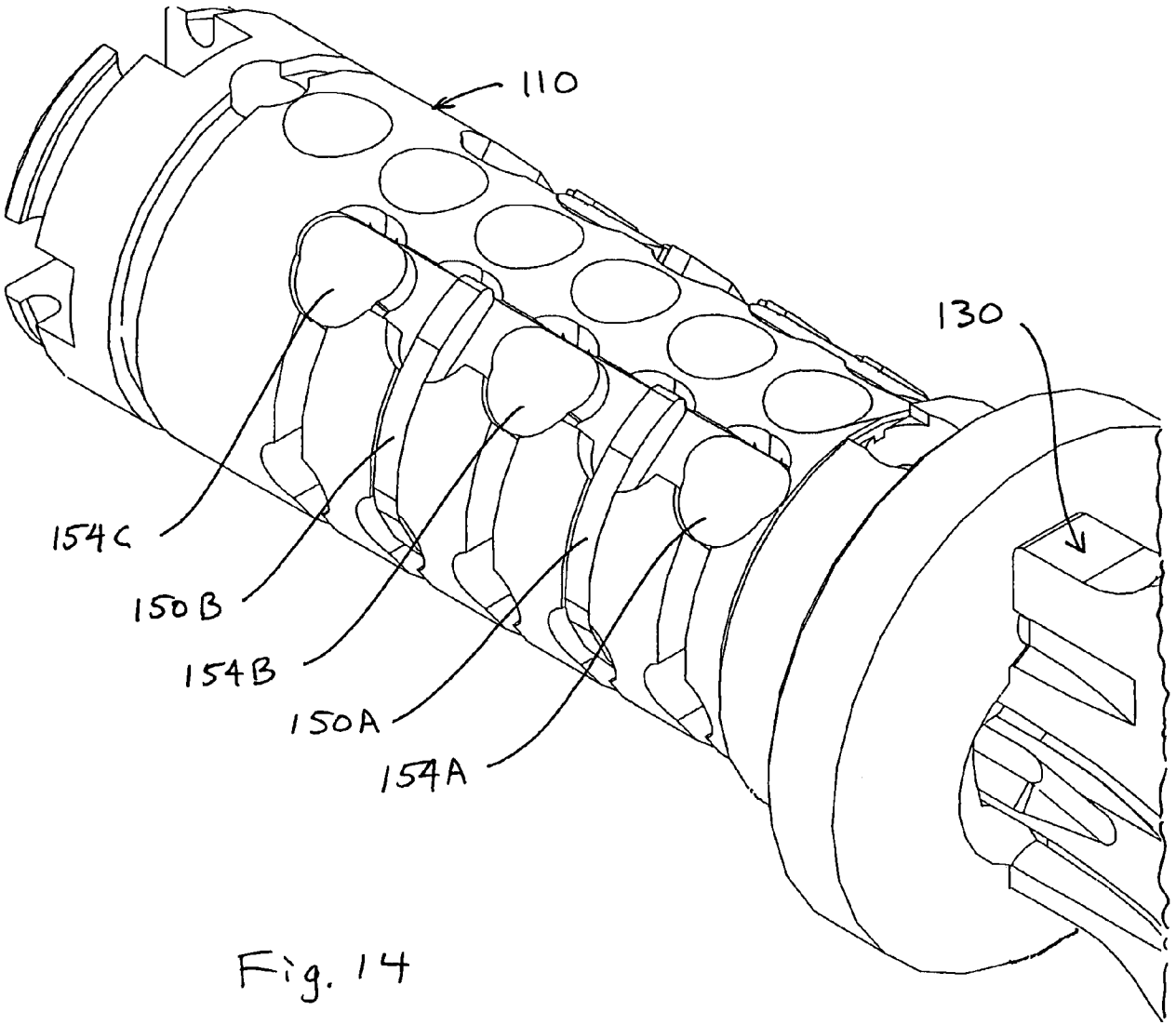
FIG. 14 is a perspective view of the properly programmed key shown in FIG. 13, fully inserted into the keyway of the programmed core shown in FIG. 12, whereby the activator inserts in the second and fourth locations have been displaced from below to the surface of the core.

The displacement of the activator inserts 150 as between the rest condition shown in FIG. 12 and the outwardly displaced condition shown in FIG. 14, results from a camming action on the inserts 150 by the program nodes 142*a*, 142*b* on the key, in a manner analogous to the interaction between the nodes 42 and activation pins 50 described with respect to the embodiment shown in FIGS. 1–10.

Figure 15:
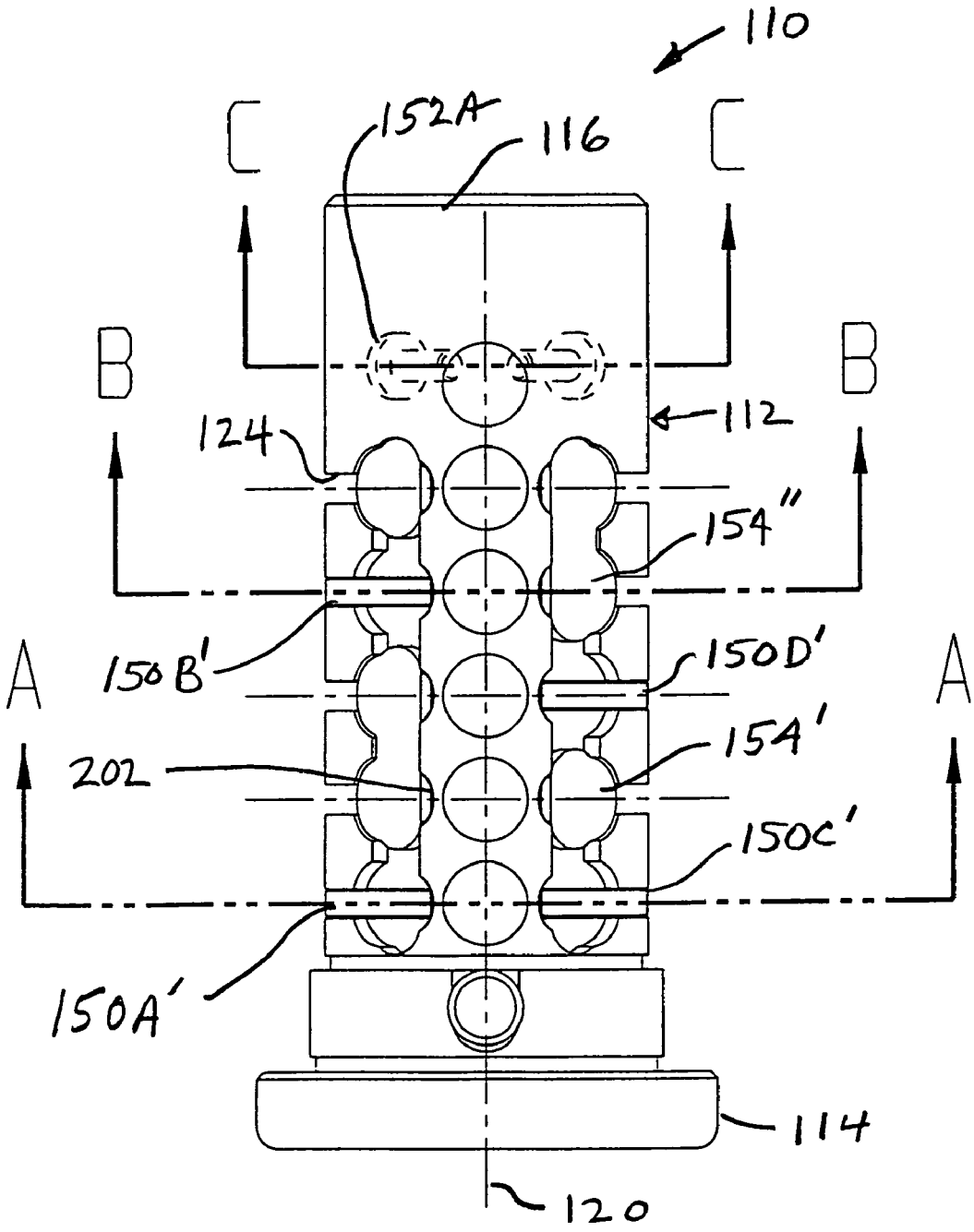
FIG. 15 is a top view of a core of the type shown in FIG. 11, but having a different programming combination of inserts.

FIGS. 15–23 provide further details regarding such interaction in this second embodiment. FIG. 15 shows a differently programmed core 110, having activator inserts 150*a*', and 150*b*' in the first and fourth left side slots, and activator inserts 150*c*' and 150*d*' in the first and third slots on the right side of the core 110. On the right side, a single filler insert or button 154' is present in the associated pocket portion of the second slot, and a double filler 154" occupies the pocket portions of the fourth and fifth right side slots. Similarly, on the left side, a double filler insert occupies the second and third slots, and a single filler occupies the fifth slot.

Figure 16:
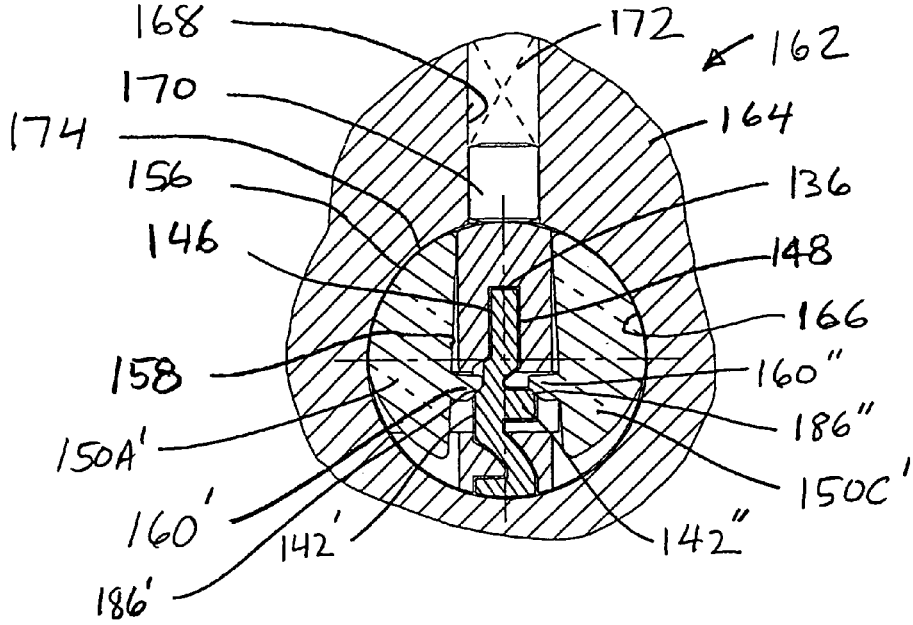
FIG. 16 is a section view taken along line A—A of FIG. 15 upon full insertion of a properly programmed key.
Figure 17:
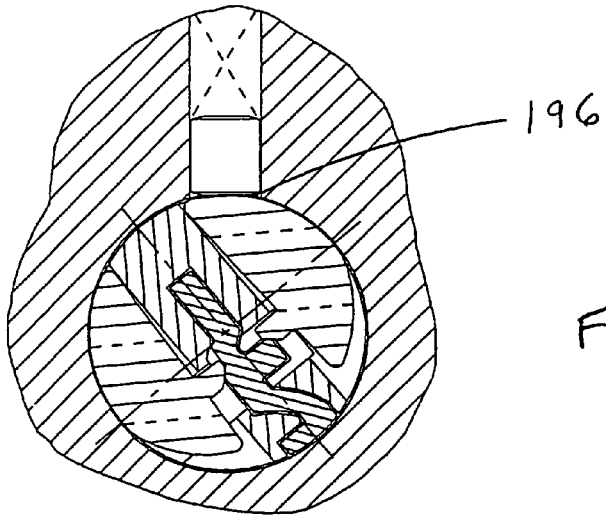
FIG. 17 is a section view similar to FIG. 16, showing the core rotated within the shell, by the properly programmed key.

FIGS. 16 and 17 are section views along the lines A—A of FIG. 15 with a properly programmed key in the keyway. With the core in the neutral, or zero degree orientation shown in FIG. 16, within shell 164, the shell, core, and key define a cylinder lock system 162. FIG. 16 depicts the situation where a key with a left side node 142' and a right side node 142" have displaced activator inserts 150*a*' and 150*c*', by means of a cam-type interaction effectuated by a nose or projection 160' and 160" on the inserts. In the neutral position shown in FIG. 16 with the properly programmed key, tumblers in the bores 176 of the core (not shown in FIG. 16 but evident in FIG. 11) align with respective shell tumblers 170 situated in respective shell bores 168 and biased by respective springs 172, to maintain continuity of the clear shear line 174 between the outer surface of the core and the inner surface 166 of the shell. Each activator insert 150*a*', 150*c*', has an arcuate outer surface 156 and an inner portion 160', 160" that enter the keyway 118. As described above, in the rest position wherein no key is present (see FIG. 12) the activator inserts are recessed from the core surface, but in the active position wherein a properly programmed key is fully inserted in the keyway, the nose on the inner portion of the insert 160', 160" bears on the nodes 142', 142" of the key, which displace the outer surface of the inserts, to the core surface.

In the preferred implementation of this embodiment, each insert is in the form of a flat plate or the like, especially a semicircle having an arcuate outer surface 156, a substantially straight diameter inner portion 158, adjacent the keyway, with the nose portion 160 projecting transversely into the keyway at all times. Upon rotation of the core with properly programmed key it can be appreciated that rotated the shear line 196 remains substantially perfectly circular due to the bridging of the pockets in the cutouts, by the outer surface 156 of the activator inserts.

Figure 18:
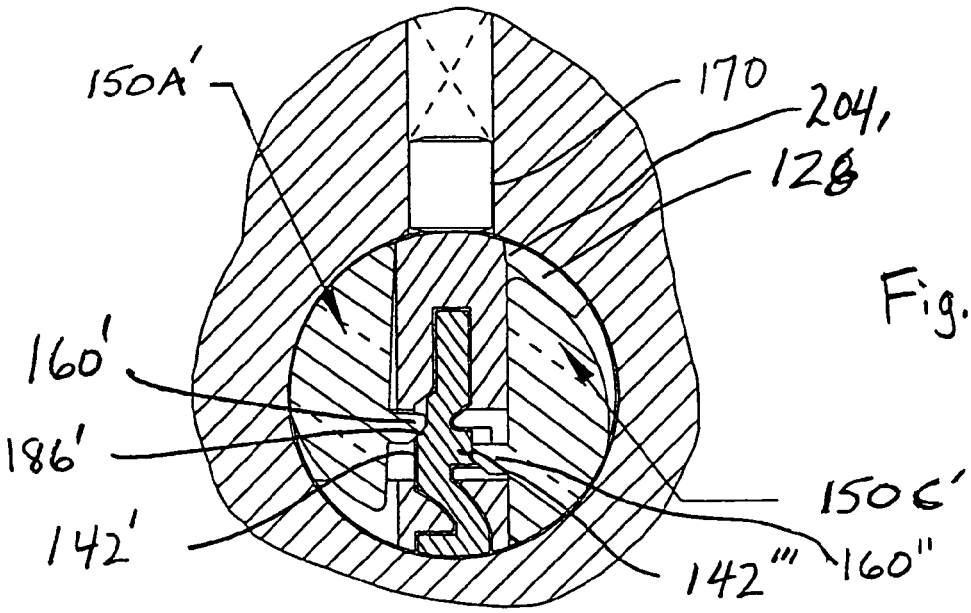
FIG. 18 is a section view along line A—A of FIG. 15, as would appear upon full insertion of an improperly programmed key.
Figure 19:
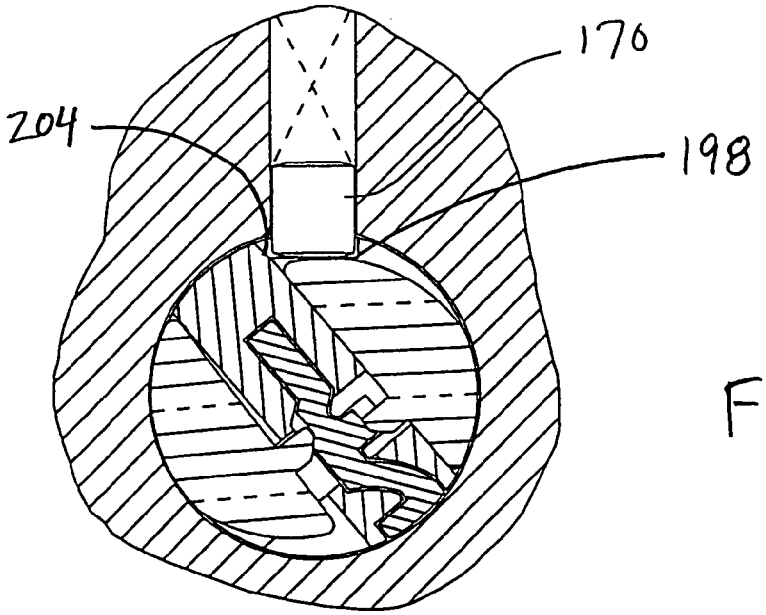
FIG. 19 is a section view similar to FIG. 18, upon partial rotation of the core with the improperly programmed key.

FIGS. 18 and 19, correspond with FIGS. 16 and 17, but when an incorrectly programmed key is inserted into the core. The node 142' on the key has properly interacted with the projection 160' at interface 186' thereby displacing insert 150*a*' to the surface of the core. However, the feature 142'" is either an improper node or a slightly recessed channel and has thus not correctly interacted with the projection 160" on insert 150*c*'. It should be appreciated that the insert 150*c*' shown in FIG. 18 corresponds to the rest position such as shown at 150*a* and 150*b* in FIG. 12. In such rest position, the pocket 128' maintains its substantially cylindrical opening, such that when the core is rotated counter-clockwise as shown in FIG. 19, the shell tumbler 170 drops into the pocket, thereby interfering at 198 with the shear line. This prevents further rotation of the core and, unless other measures are taken as described below, prevents further rotation in either direction, thereby trapping the key.

If key trapping is not desired, the edges of the pockets can be beveled or chamfered as indicated at 204, on the side adjacent the core tumbler bores 176, thereby providing a sloped, rather than right angle surface at the portion of the shelf tumbler 170 that has entered the pocket.

Figure 20:
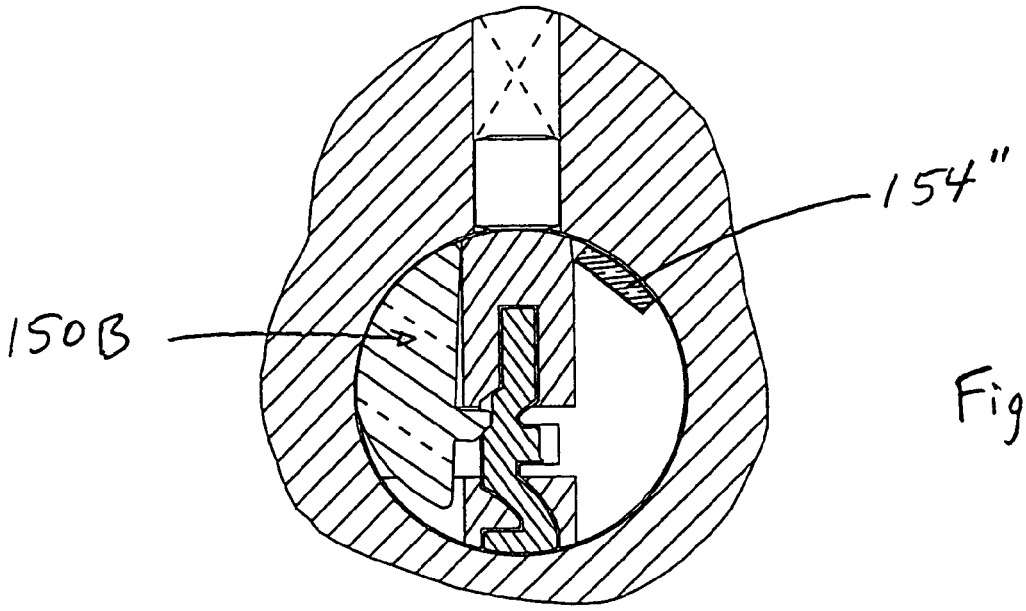
FIG. 20 is a section view through line B—B of FIG. 15 showing a filler insert and an activator insert.
Figure 21:
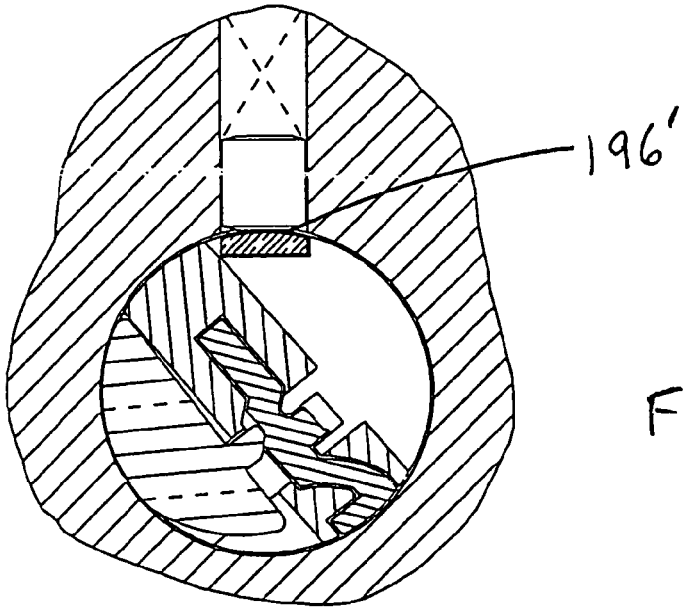
FIG. 21 is a section view similar to FIG. 20, showing the condition upon rotation of the core.

FIGS. 20 and 21 show the role of the filler insert or button 154", at section B—B of FIG. 15. The insert maintains continuity in the outer surface of the core such that the shear line 196' is maintained clear, at least at the longitudinal position along the core where the filler insert is utilized.

Figure 22:
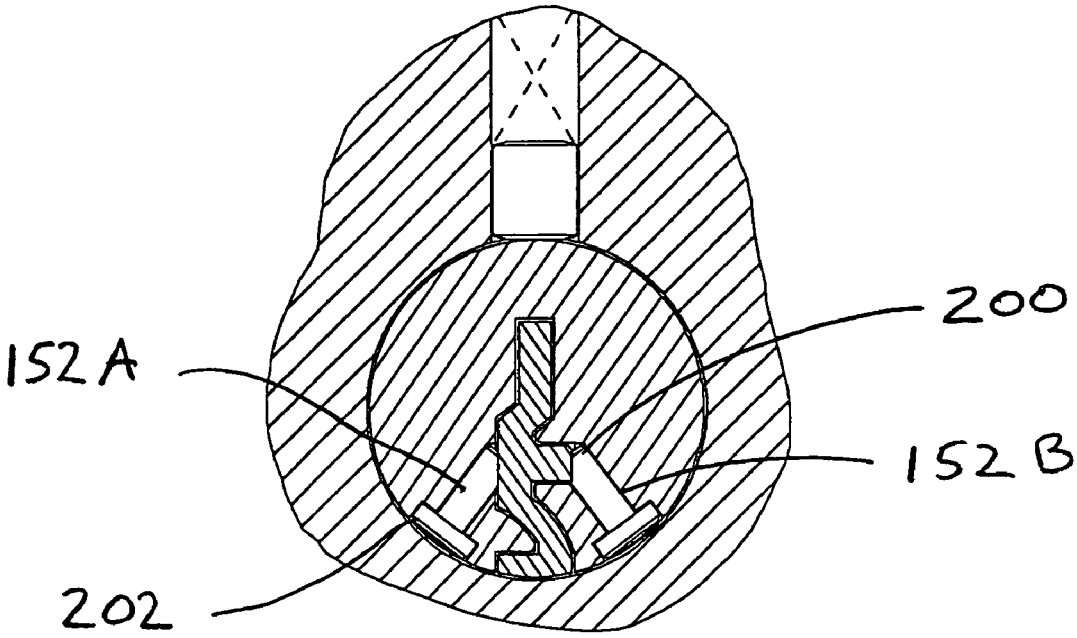
FIG. 22 is a section view through line C—C of FIG. 15, showing the effect of blocking pins to prevent the full insertion of an unauthorized key into the keyway.

A further optional feature includes provision of blocking pins to prevent full insertion of a non-milled key. As shown in FIG. 22, blocking bores 202 would be present adjacent the back end 116 of the core, distinct from the cutouts for receiving the programming inserts 150, 154. It can be appreciated that if a key such as depicted in FIG. 13 is inserted into a core such as depicted in FIG. 15, and the channel portion 140*b* near the tip 178, of the key does not have a properly milled channel of sufficient depth at the correct height along the key blade, the forward portion of the key will encounter the forward portions of the blocking pins 152*a*, 152*b* in the interference condition such as depicted. As a result, the key will not fully insert into the keyway.

In the embodiment shown in FIG. 11, the cutouts 124 include a lower counter bore 202 that provides a through passage from the surface of the core to the keyway, with such bore 202 being distinct from the bore defining pockets 128. A blocking pin such as shown at 152*a* and 152*b* in FIG. 22 can be inserted through each bore in conjunction with the presence of a filler insert 154 in the pocket 128 at the outer end of the same cut-out 124. Thus, the blocking pin would not interfere with an activator insert, because such activator insert would not be present in the same cutout as where a filler insert would be present.

The preferred key associated with the second embodiment of the invention will now be discussed with particular reference to FIGS. 13, 16, 23, and 24. It can be appreciated that the top and bottom edges 136, 138 of the blade define a blade height direction and the left and right flanks 146, 148 define a blade width direction. The longitudinal channel 140 has a width extending in the blade height direction and a depth extending in the blade width direction. The node 142*b* is situated in the channel and has a front ramp 180 facing the tip 178 of the blade, and a back ramp 182 facing the bonnet 132, a side face 184 between the front and back ramps 180, 182, and an actuator surface 186 contiguous with the front ramp, back ramp, and side surface. The actuator surface 186 engages the projection 160 on an actuator insert for maintaining the insert at the activated position wherein the outer surface 156 provides the bridge for maintaining shear line clearance upon rotation of the core within the shell. The side surface 184 of the node does not normally come into play in performing the role of displacing the activator pin. Rather, the node ramps 180, 182 cause a compound angular movement of the activator disc, as the projection 160 is thereby forced to move from resting on the clear portion 140*b* of the channel, up to the actuator surface 186 of the node. In particular, the actuator surface 186 preferably extends at an oblique angle to both the key height direction and the key thickness direction. This surface 186 engages a complimentary angled surface on the lower side of the projection 160.

To facilitate this compound movement, the front ramp 180 forms a front notch 188 with the channel and the back ramp 182 forms a back notch 190 with the channel. The notches define respective front and back transition slopes leading to the actuator surface 186. Each transition slope 188, 190 has a converging surface, with the apex contiguous with the actuator surface.

Figure 23:
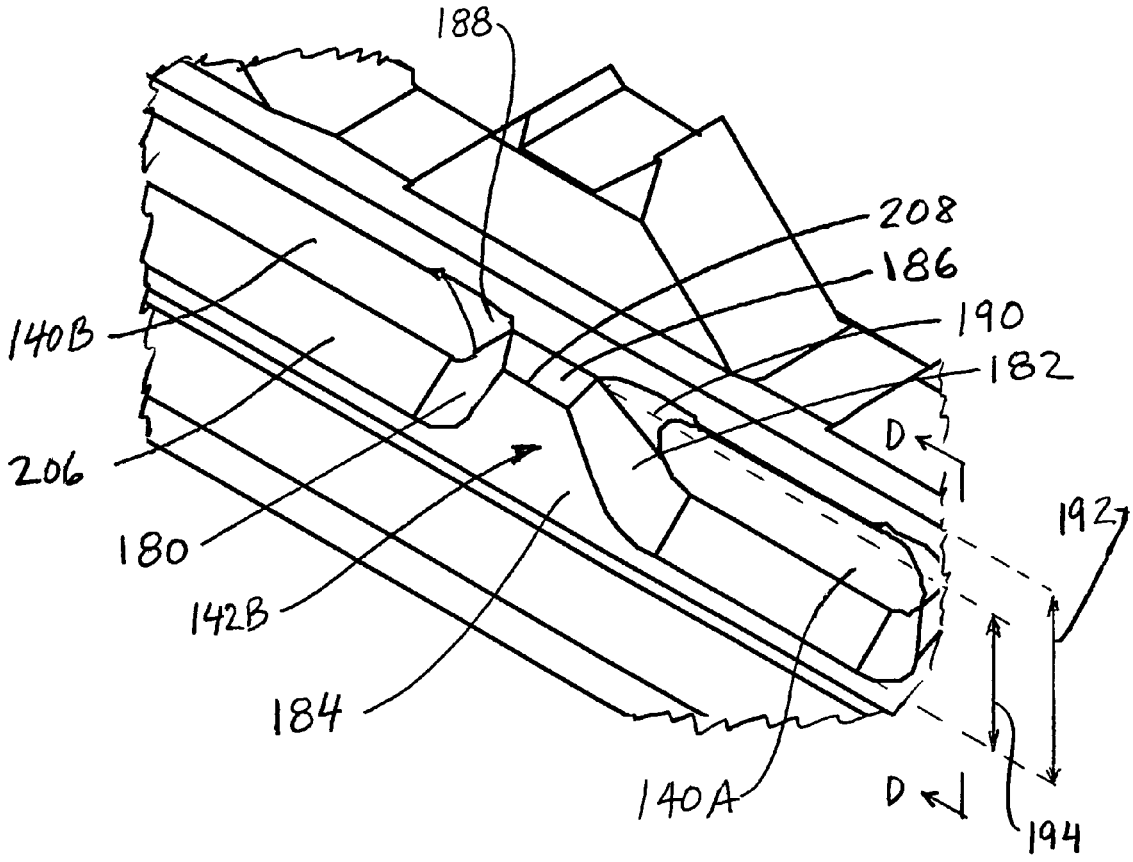
FIG. 23 is a perspective view, showing an enlarged portion of the key depicted in FIG. 13, where details of a program node are more evident.

The channel width is indicated at 192 in FIG. 23 and it can be appreciated that the height 194 of the node 142*b* is less than the width of the associated channel. With reference to FIG. 18, it can be appreciated that when the actuator insert 150*c'* shown on the right side is in the rest position, the nose 160" projects into the keyway laterally of the channel in which incorrect node or channel 142'" is shown. The incorrect node in that view has not displaced the insert. Nevertheless, it can be appreciated that with a properly located and shape node, such as 142" shown in FIG. 16, the channel will first engage the projection upstream of the node and the projection will ride in the channel until it encounters the front ramp 180 shown in FIG. 23 and thereafter the compound angle both lifts and laterally displaces the insert until it achieves its actuated position on the actuator surface 186 (as shown at the interaction of 160' and 186' in FIG. 16). It can thus be appreciated that in this embodiment, the projection from the insert is in the keyway both in the rest position (such as 160" in FIG. 18), and after actuation by a properly programmed key (such as 160' in FIG. 16).

To facilitate smooth insertion of the key while the projections of the activator inserts are in the channels, the surface 206 on which the projection rides until it reaches the ramp, can also be angled in a manner analogous to the oblique angle of the activator surface 186. Furthermore, it can also be appreciated that the difference in the dimensions 192 and 194 shown in FIG. 23, provides space for the projection to find support on the activator surface 186, while the projection 160 remains "in" the channel, as evident from FIG. 16.

Figure 24:
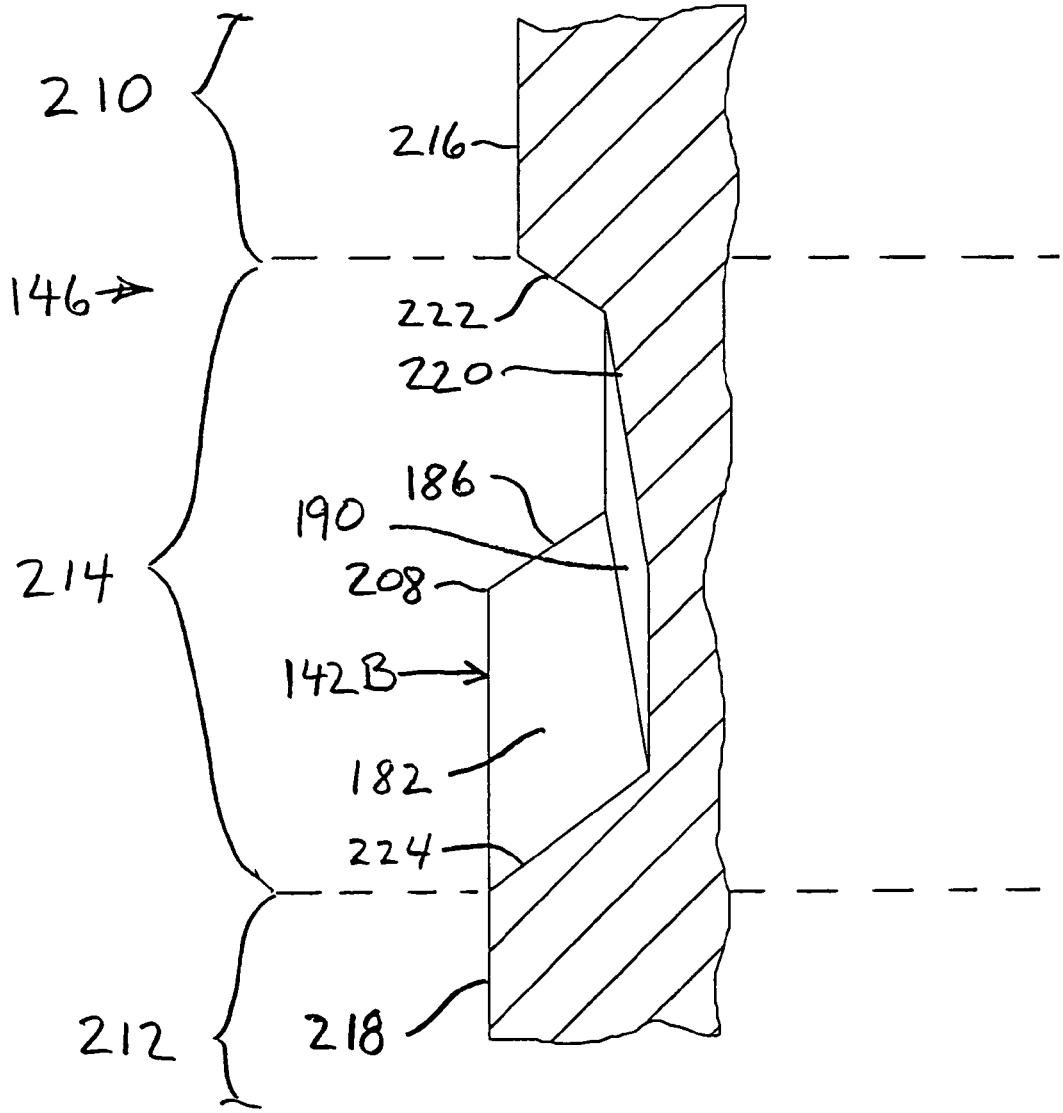
FIG. 24 is a partial section view of the key of FIGS. 13 and 23, along line D—D.

This inventive concept for the key can be expressed more generally with respect to FIG. 24. The section line is taken at a channel location such as 140*a* in FIG. 23 whereby upon viewing in a longitudinal direction toward the tip of the blade, one can see the node 142*b* situated farther along in the channel zone. The blade profile forms a longitudinally extending upper rectangular region 210 having a substantially vertical upper wall 216 on one flank and a longitudinally extending lower rectangular region 212 having a substantially vertical lower wall 218 on the same flank. The longitudinally extending intermediate region between the upper and lower rectangular regions defines a longitudinal channel zone 214 that is in relief relative to the upper and lower walls 216, 218. This channel zone is defined by the channel base 220 and surfaces 222, and 224 all of which can be rectilinear or one or more of which can be obliquely oriented relative to the height dimension of the key, as shown at 224. Thus, the term "rectangular region" as used above, should be understood as compatible with the oblique surface 224 as implied by the broken lines showing the boundary between regions 214 and 218.

Regardless of the shape of the channel zone, the zone is formed by milling to achieve the relief relative to the vertical upper and lower walls 216, 218 on the respective upper and lower regions. At least one raised node 142*b* is situated in the channel zone, having the ramps 182 and actuator surface 186 as previously discussed, preferably with the actuator surface having an orientation that is oblique with respect to the upper and lower walls of the profile. It is most convenient for manufacturing purposes, if the outer edge 208 of the actuator surface is vertically aligned with one of the walls, in particular, with the lower wall 218. It can also be seen that the activation surface 186 is spaced from the upper region 216.

The broken boundary lines on three sides of the portion of the key depicted in FIG. 24 indicate that additional channels or profiles may be present above and below the regions 216, 218, and that no channel, or a different size channel, can be present to the right, associated with the other flank of the blade.

Figure 25:
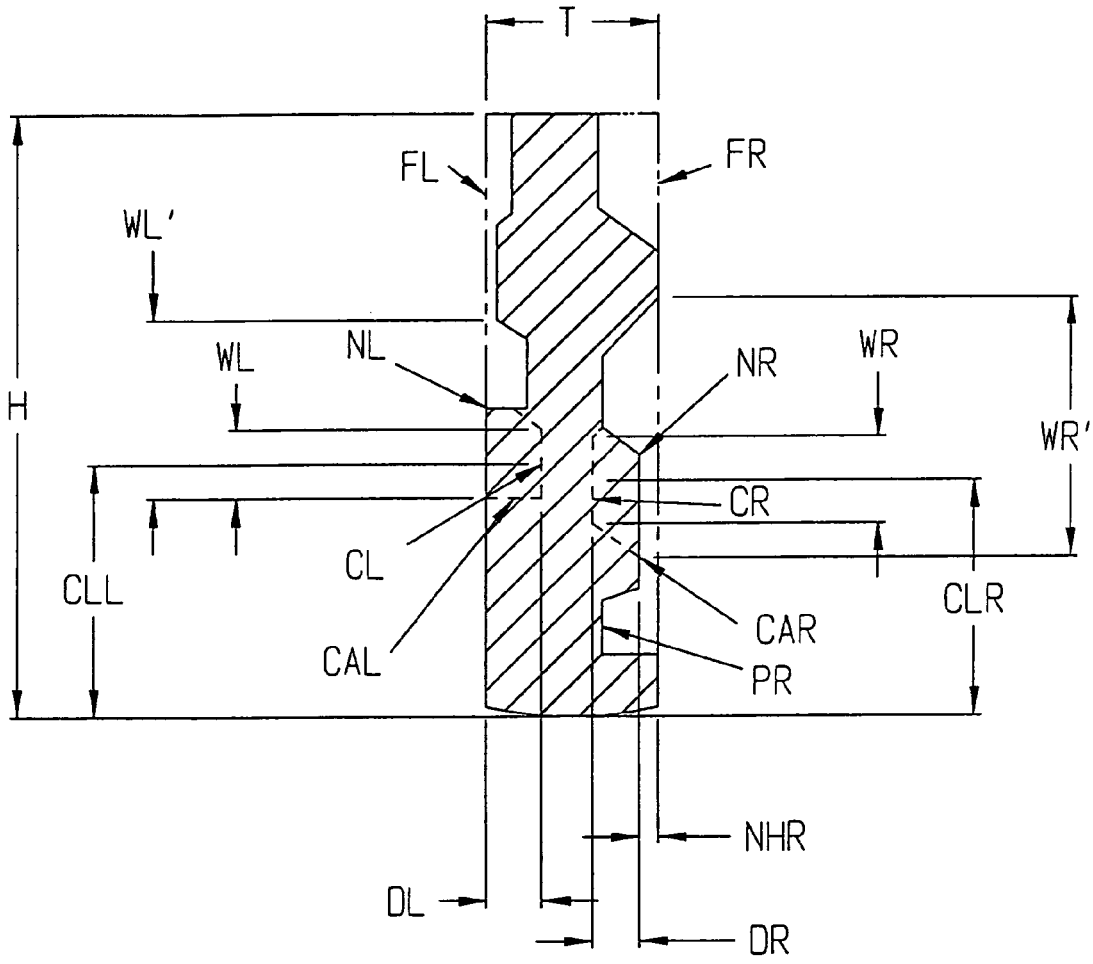
FIG. 25 is a schematic rendition of a key blank having certain features according to the present invention, with dimensions identified for convenience in describing optional implementations of the present invention.

The inventive key is generalized to an even greater extent in the schematic shown in FIG. 25. The following legend defines the labeling on FIG. 25:

T=overall key blank (billet) thickness
H=key blade height
FL=Left flank of T
FR=Right flank of T
NL=Left node
NR=Right node
CL=Left channel
CR=Right channel
PR=Right side additional profile
DL=Depth of left channel
DR=Depth of right channel
WL=Width of left channel base
WL'=Width of left channel zone
WR=Width of right channel base
WR'=Width of right channel zone
CLL=Centerline of left channel base
CLR=Centerline of right channel base
CAL=Left channel angle
CAR=Right channel angle
NHR=Right side node height The solid lines represent any given key milling profile, and in this case a section line is shown through opposing nodes. The hidden dashed lines represent portions of the channels which extend inwardly and outwardly from the plane of the paper. The phantom dashed line represents the solid key blank (billet) prior to milling of the key. Thus, in the illustrated schematic, the upper region has a left side wall that has been milled relative to the original billet left flank, whereas the milling on the right side leaves a portion at the billet right flank. Similarly, the lower region of the key, especially near the bottom edge, leaves material in original left and right billet flanks. In the left side channel zone, the side face of the node is at the billet left flank line, whereas the side face of the right side node has been milled flat relative to the original right side flank line.

The inventive key can be implemented according to the invention within a multi-variable window, of the following parameters:

CLL and CLR can be different
WL and WR can be different
WL' and WR' can be different
DL and DR can be different
NHR does not have to be at FR (also true for the left side)
CAL and CAR can be different Nodes and channels can be on one side or the other or both (as shown).

The node height should never be higher than the FR or FL billet flanks, however, the node(s) may be highest plane on a particular side of a key. A regular profile milling may mill away the material in all areas except the node area itself.

WR and/or WL could (technically) continue down to the bottom of the key without affecting functionality of the key, as long as the node ramp is still in place.

The invention claimed is:

1. A key blank for a key insertable in a keyway of a cylinder lock having a protection operatively associated with the keyway for displacement by said key, comprising:

a bonnet for grasping with fingers;

a blade extending in a longitudinal direction from the bonnet to a distal tip, and having top and bottom edges spaced apart along a blade height direction and left and right flanks spaced apart along a blade width direction;

a longitudinal channel in at least one flank, said channel having a base between two walls which together define a channel width extending in the blade height direction and a channel depth in the blade width direction; and at least one raised node situated in said channel, each node having a front ramp facing the tip of the blade for guiding said protection parallel to the channel base and toward one channel wall, a back ramp facing the bonnet for guiding said protection parallel to the channel base and toward the other channel wall, a side face between the front and back ramps defining a substantially flat side surface substantially parallel to the blade height direction, and an actuator surface contiguous with the front ramp, back ramp, and side surface, for receiving said protection from either ramp and urging said protection in a direction away from the channel base.

2. The key blank of claim 1, wherein the actuator surface extends at an oblique angle to both the blade height and blade thickness directions.

3. The key blank of claim 2, wherein the front ramp forms a front notch with the channel and the back ramp forms a back notch with the channel, and wherein the notches define respective front and back transition slopes leading to said actuator surface.

4. The key blank of claim 3, wherein each transition slope has a converging surface with an apex contiguous with said actuator surface.

5. The key blank of claim 3, wherein each node has a height in the blade height direction, that is less than the width of the associated channel.

6. The key blank of claim 1, coded as a key comprising coded primary bitting along one of said top and bottom edges.

7. The key blank of claim 2, coded as a key comprising coded primary bitting along one of said top and bottom edges.

8. A key blank for a cylinder lock, comprising:

a bonnet for grasping with fingers;

a blade extending in a longitudinal direction from the bonnet to a distal tip, and having top and bottom edges spaced apart along a blade height direction and left and right opposed flanks defining a cross sectional profile;

said profile forming a longitudinally extending upper, substantially rectangular region having a vertical upper wall on one flank, a longitudinally extending lower substantially rectangular region having a vertical lower wall on said one flank, and a longitudinally extending intermediate region between the upper and lower substantially rectangular regions, said intermediate region defining a longitudinally extending channel zone on said one flank that is in relief relative to the upper and lower walls;

at least one raised node situated in said channel zone, each node having a front ramp facing the tip of the blade and oriented obliquely with respect to said vertical lower wall, a back ramp facing the bonnet oriented obliquely with respect to said vertical lower wall, and an actuator surface between the front ramp and the back ramp, said actuator surface having an orientation that is oblique with respect to said lower wall and said ramps.

9. The key blank of claim 8, wherein said node rises from the relief of the channel zone such that an edge of said actuator surface is vertically aligned with one of said walls.

10. The key blank of claim 8, wherein the channel zone extends from the lower region to the upper region and the actuator surface is spaced from the upper region.

11. The key blank of claim 8, wherein the actuator surface is spaced from the upper region.

12. A key blank of claim 8, coded as a key comprising coded primary bitting along one of said top and bottom edges.

13. The key blank of claim 9, coded as a key comprising coded primary bitting along one of said top and bottom edges.

14. The key blank of claim 10, coded as a key comprising coded primary bitting along one of said top and bottom edges.

15. The key blank of claim 11, coded as a key comprising coded primary bitting along one of said top and bottom edges.

16. The key blank of claim 8, wherein the front ramp and the back ramp extend at an oblique angle to the blade height direction, and said actuator surface is oblique with respect to the blade height direction and to said ramps.

* * * * *

UNITED STATES PATENT AND TRADEMARK OFFICE

CERTIFICATE OF CORRECTION

PATENT NO. : 7,207,200 B2
APPLICATION NO. : 11/223483
DATED : April 24, 2007
INVENTOR(S) : Eden, Jr. et al.

It is certified that error appears in the above-identified patent and that said Letters Patent is hereby corrected as shown below:

Column 13:

Line 63, delete “protection” and substitute --projection--.

Column 14:

Line 9, delete “protection” and substitute --projection--.

Line 11, delete “protection” and substitute --projection--.

Line 17, delete “protection” and substitute --projection--.

Lines 17 and 18, delete “pro-tection” and substitute --pro-jection--.

Signed and Sealed this

Sixth Day of November, 2007

JON W. DUDAS
*Director of the United States Patent and Trademark Office*